US010974265B1

(12) United States Patent
Ventresca

(10) Patent No.: US 10,974,265 B1
(45) Date of Patent: Apr. 13, 2021

(54) SPRAY DEVICE WITH INTERCHANGEABLE CARTRIDGES AND METHODS OF USE

(71) Applicant: Paul Sung Ventresca LLC, Somerville, MA (US)

(72) Inventor: Paul Sung Ventresca, Somerville, MA (US)

(73) Assignee: Paul Sung Ventresca LLC, Somerville, MA (US)

( * ) Notice: Subject to any disclaimer, the term of this patent is extended or adjusted under 35 U.S.C. 154(b) by 0 days.

(21) Appl. No.: 16/518,219

(22) Filed: Jul. 22, 2019

Related U.S. Application Data

(60) Provisional application No. 62/764,217, filed on Jul. 22, 2018.

(51) Int. Cl.
*B05B 11/00* (2006.01)
*B05B 7/24* (2006.01)

(52) U.S. Cl.
CPC ..... *B05B 11/0054* (2013.01); *B05B 7/2464* (2013.01); *B05B 11/0081* (2013.01); *B05B 11/30* (2013.01)

(58) Field of Classification Search
CPC .. B05B 11/0054; B05B 11/0081; B05B 11/30
USPC ..... 222/145.5
See application file for complete search history.

(56) References Cited

U.S. PATENT DOCUMENTS 2,941,696 A * 6/1960 Homm ..... B65D 83/68 222/136
3,150,050 A * 9/1964 Safrin ..... C11B 9/025 512/5
3,236,418 A * 2/1966 Dalle ..... B65D 83/682 222/135
3,760,986 A * 9/1973 Castner ..... B05B 11/0056 222/137
3,786,963 A * 1/1974 Metzler, III ..... B05B 11/3081 222/136
4,265,372 A * 5/1981 Wainberg ..... B05B 11/0078 222/82
4,355,739 A * 10/1982 Vierkotter ..... B05B 11/3083 222/134
4,496,081 A * 1/1985 Farrey ..... B05B 1/30 222/135
4,773,562 A * 9/1988 Gueret ..... A45D 40/24 222/135
4,902,281 A * 2/1990 Avoy ..... A61B 17/00491 222/137

(Continued)

*Primary Examiner* — Michael J. Melaragno
(74) *Attorney, Agent, or Firm* — John Brooks Law LLC; John J. Brooks, III

(57) ABSTRACT

A spray device for delivering a mixture of fluids is disclosed comprising a removable fluid concentrate reservoir configured to hold a fluid concentrate, a single pump in fluid communication with the removable fluid concentrate reservoir and a fluid dilute reservoir and a top section comprising a manifold configured to mix a portion of the contents of the removable fluid concentrate reservoir with a portion of the fluid dilute reservoir. In some embodiments, the removable fluid concentrate reservoir is a removable concentrate cartridge and the fluid dilute reservoir is a removable dilute cartridge. In some embodiments, the fluid concentrate comprises a perfume. In some embodiments, the fluid concentrate comprises an essential oil.

20 Claims, 28 Drawing Sheets

(56) References Cited

U.S. PATENT DOCUMENTS 5,009,342 A 4/1991 Lawrence et al.
5,152,461 A * 10/1992 Proctor ..... B05B 11/0064 239/304
5,213,264 A 5/1993 Styne
5,332,157 A * 7/1994 Proctor ..... B05B 11/0064 239/304
5,332,158 A 7/1994 Styne et al.
5,385,270 A * 1/1995 Cataneo ..... B05B 11/3081 222/134
5,398,733 A * 3/1995 Welch ..... B67D 1/0021 137/3
5,398,846 A * 3/1995 Corba ..... B05B 11/0029 222/1
5,402,916 A * 4/1995 Nottingham ..... B05B 11/3004 222/134
5,439,141 A * 8/1995 Clark ..... B05B 11/0056 222/136
5,472,119 A * 12/1995 Park ..... B05B 11/3081 222/136
5,560,545 A 10/1996 Grogan et al.
5,626,259 A 5/1997 Maas et al.
5,634,571 A * 6/1997 Cataneo ..... B05B 7/32 222/134
5,769,275 A * 6/1998 Boehmer ..... B05B 11/3081 222/136
5,819,987 A * 10/1998 Miller ..... B05B 11/3081 222/135
5,865,347 A * 2/1999 Welschoff ..... B05B 11/0054 222/137
5,899,362 A * 5/1999 Moran ..... B01F 15/0429 222/136
5,944,223 A * 8/1999 Klima ..... B05B 11/0056 222/129
6,427,870 B2 * 8/2002 De Laforcade ..... B01F 3/0861 222/1
6,450,366 B1 * 9/2002 de Laforcade ..... B01F 3/0861 222/1
6,550,694 B1 4/2003 Foster
6,736,169 B2 * 5/2004 De Laforcade ..... B01F 3/0861 141/9
6,843,390 B1 * 1/2005 Bristor ..... B05B 11/3081 222/145.5
7,290,681 B2 * 11/2007 Decottignies ..... B05B 11/0078 222/135
7,875,001 B2 * 1/2011 Minotti ..... A61M 15/08 222/137
8,931,668 B2 * 1/2015 Alluigi ..... B05B 11/0037 222/382
9,061,293 B2 * 6/2015 Beaulieu ..... B05B 1/14
9,180,476 B2 * 11/2015 Werner ..... B05B 11/3083
9,192,949 B2 * 11/2015 Lang ..... B05B 11/3081
9,643,199 B2 * 5/2017 Petkus ..... C11D 17/041
9,649,650 B2 * 5/2017 Werner ..... B05B 15/20
9,925,550 B2 * 3/2018 Dring ..... B05B 11/3084
9,931,657 B2 * 4/2018 Gonzalez ..... B05B 11/3057
2003/0108487 A1 * 6/2003 Bara ..... A45D 34/04 424/47
2004/0159677 A1 * 8/2004 Hwang ..... B05B 11/3081 222/145.5
2004/0251282 A1 * 12/2004 Butler ..... B05B 11/0081 222/383.1
2005/0263613 A1 * 12/2005 Beck ..... B05B 7/2472 239/304
2009/0216183 A1 * 8/2009 Minotti ..... A61M 15/08 604/82
2010/0090027 A1 * 4/2010 Knopow ..... B05B 7/2443 239/306
2010/0206903 A1 * 8/2010 Banco ..... B05B 11/3011 222/136
2011/0215113 A1 * 9/2011 Hansen ..... B65D 83/202 222/136
2012/0279990 A1 * 11/2012 Werner ..... B05B 11/3083 222/132
2014/0061233 A1 * 3/2014 Lang ..... B05B 11/0054 222/1
2014/0078857 A1 * 3/2014 Nelson ..... B01F 15/0238 366/182.1
2014/0183280 A1 * 7/2014 Mafi ..... B05B 7/0408 239/318
2014/0239094 A1 * 8/2014 Munro ..... B65D 83/682 239/304
2015/0231658 A1 * 8/2015 Werner ..... B05B 15/20 222/145.6
2015/0298865 A1 * 10/2015 Kolb ..... B65D 81/3283 222/145.5
2015/0352571 A1 * 12/2015 Petkus ..... B05B 7/2464 222/1
2016/0074888 A1 * 3/2016 Lang ..... B05B 11/3094 222/464.1
2017/0165689 A1 * 6/2017 McDonnell ..... B05B 7/2408

* cited by examiner

SPRAY DEVICE WITH INTERCHANGEABLE CARTRIDGES AND METHODS OF USE

CROSS-REFERENCE TO RELATED APPLICATIONS

This application claims the benefit of U.S. App. No. 62/764,217, filed on Jul. 22, 2018, entitled "Cartridge-Based interchangeable Infusion Bottle," the entire contents of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

1. Field of the Invention

The present invention is related to mechanisms and methods for delivering variable mixtures of fluids. More specifically, the present invention is related to mechanisms and methods that use replaceable cartridges to deliver mixtures of fluids. In an example embodiment, the spray device uses two removable cartridges, one for a dilute solution and one for a concentrate solution, to deliver the mixture of fluids delivered through a spray pump mechanism.

2. Background of the Invention

When it comes to dispensing small amounts of fluids from containers, such as spray bottles for fragrances or hair products, individuals typically rely on a single bottle filled with between 15 mL to 100 mL of perfume or cologne. The current market for fragrances leaves individuals to purchase one singular bottle, which, due to factors such as size and cost, may be sparingly used for months, even years. These aforementioned factors also can lead to a lack of variation in an individual's personal collection of fragrances. The present invention overcomes these deficiencies and allows a consumer to enjoy multiple fragrances, giving them the opportunity to purchase multiple smaller cartridges which they are able to change within the spray device.

The current market also creates a significant amount of waste in that the container components are not refilled or reused. The present invention overcomes this deficiency by creating a container with components that can be reused and refilled.

BRIEF SUMMARY OF THE INVENTION

The following summary is included only to introduce some concepts discussed in the Detailed Description below. This summary is not comprehensive and is not intended to delineate the scope of protectable subject matter, which is set forth by the claims presented at the end.

It is an object of the invention to obviate the disadvantages of the prior art. In some embodiments, a spray device is provided that allows a consumer to enjoy the delivery of varying mixtures of fluids from cartridges within a small spray device, giving them the opportunity to purchase different cartridges which they are able to change within the spray device to vary the mixture of fluids.

In one example embodiment, the spray device uses multiple cartridges (one for a dilute solution, and one for a concentrate solution) and a pump mechanism to deliver the fluid mixture. After the pump mechanism is actuated, the fluid is drawn through tubes from each cartridge in a predefined ratio, is combined in a manifold, and drawn up through the pump mechanism resulting in a customized spray. In some embodiments, the design of the spray device mimics the aesthetics and feel of an antique seltzer bottle.

In one embodiment, a spray device is provided and methods of use allow for the customization of fluid to be delivered from a spray device.

In one example embodiment, a spray device is provided having two interchangeable cartridges, one holding a fluid dilute and the other holding a fluid concentrate. For example only, and not for limitation, one cartridge may contain a scentless base oil as the fluid dilute and the other cartridge may contain a concentrated fragrance as the fluid concentrate. When the pump mechanism is actuated at the top of the device, fluid is drawn up from each cartridge in a predetermined ratio, which is controlled through the ratio of the diameters of each of the delivery conduits coming from each cartridge. The fluids from each cartridge then converge and mix at a manifold in the middle of the spray device, and that combined fluid is drawn up through the cap using a cap pump mechanism, ultimately released in a spray. The cartridges are interchangeable, allowing a user to alternate the fluids in the cartridge and replace the fluids when they are empty. For example, if the concentrate solution is a fragrance and the dilute solution is a scentless oil, the fragrance may be changed when desired by changing the cartridge to one containing a different fragrance.

In one example embodiment, a spray device for delivering a mixture of a fluid concentrate and a fluid dilute is provided comprising a removable fluid concentrate reservoir configured to hold a fluid concentrate. a fluid dilute reservoir configured to hold a fluid dilute, a pump in fluid communication with the removable fluid concentrate reservoir and the fluid dilute reservoir, a top section comprising a manifold and a pump, the manifold configured to mix a portion of a fluid concentrate from the removable fluid concentrate reservoir with a portion of the fluid dilute from the fluid dilute reservoir, and the pump in fluid communication with the manifold whereby the pump can receive the fluid concentrate and the fluid dilute from the manifold and deliver a mixture of the fluid concentrate and the fluid dilute. In some embodiments, the removable fluid concentrate reservoir is defined by a removable fluid concentrate cartridge, and the fluid dilute reservoir is defined by a removable fluid dilute cartridge. In some embodiments, the fluid concentrate comprises a perfume. In some embodiments, the fluid concentrate comprises an essential oil.

In some embodiments, the spray device further comprises the pump in fluid communication with an internal conduit of the manifold whereby the pump can receive the fluid concentrate and the fluid dilute from the internal conduit, a middle section coupled to the top section and configured to retain the manifold in the top section, the removable fluid concentrate cartridge and the removable fluid dilute cartridge each having a lid with a manifold coupler configured to couple with a cartridge lid engagement area in the manifold, a sealing ring configured to couple and fluidly seal the manifold coupler with the cartridge lid engagement area, the removable fluid concentrate cartridge and the removable fluid dilute cartridge each having a shoulder recess configured to mate with a middle shoulder of the middle section, and the removable fluid concentrate cartridge and the removable fluid dilute cartridge each having a tube configured to mate with a tube coupler and the manifold whereby the internal conduit of the manifold is in fluid communication with the removable fluid concentrate reservoir and the fluid dilute reservoir.

In some embodiments, the coupling of the manifold coupler with the cartridge lid engagement area limits movement of the removable fluid concentrate cartridge in a direction parallel to a longitudinal axis of the spray device, and the mating of the shoulder recess and the middle shoulder limits a movement of the removable fluid concentrate cartridge in a direction perpendicular to the longitudinal axis of the spray device.

In some embodiments, the spray device further comprises a removable bottom section configured to retain the removable fluid concentrate cartridge and the removable fluid dilute cartridge.

In some embodiments, the spray device further comprises the pump in fluid communication with an internal conduit of the manifold whereby the pump can receive the fluid concentrate and the fluid dilute from the internal conduit, the internal conduit comprising a concentrate conduit and a dilute conduit, the concentrate conduit having a constricted concentrate conduit area, the dilute conduit having a constricted dilute conduit area, and a ratio of the constricted concentrate conduit area to the constricted dilute conduit area defining a mixing ratio of the fluid concentrate and the fluid dilute. In some embodiments, the constricted concentrate conduit area is defined by a fluid concentrate tube in the removable fluid concentrate cartridge. In some embodiments, the constricted concentrate conduit area is defined by a fluid concentrate conduit of the internal conduit of the manifold. In some embodiments, the ratio comprises a range of about 5:1 to 10:1.

In some embodiments, a removable fluid cartridge to hold a fluid for use with a spray device, is provide. The cartridge comprising a cartridge body defining a side and a bottom of a cartridge reservoir configured to retain a fluid, a cartridge lid configured to define a top of the cartridge reservoir, a tube coupled to the cartridge lid, the tube extending into the cartridge reservoir and configured to fluidly connect the fluid reservoir to the cartridge lid, the cartridge lid further comprising a lid coupler configured to fluidly connect the tube with the spray device whereby the fluid retained in the cartridge reservoir may be dispense by a pumping mechanism of the spray device, the cartridge body further comprising a recess configured to mate with the spray device, and the recess and the lid coupler configured to couple the cartridge body with the spray device.

Other objects, features, and advantages of the techniques disclosed in this specification will become more apparent from the following detailed description of embodiments in conjunction with the accompanying drawings.

BRIEF DESCRIPTION OF THE SEVERAL VIEWS OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

These and other features and advantages of the present invention will become more readily appreciated and better understood by reference to the following detailed description when considered in connection with the accompanying drawings:

FIGS. 22A-22G respectively show a top-side-rear perspective, right side, left side, rear, front, top and bottom views illustrating an ornamental design for a removable cartridge for a spray device with interchangeable cartridges.

DETAILED DESCRIPTION OF THE INVENTION

Figure 1A:
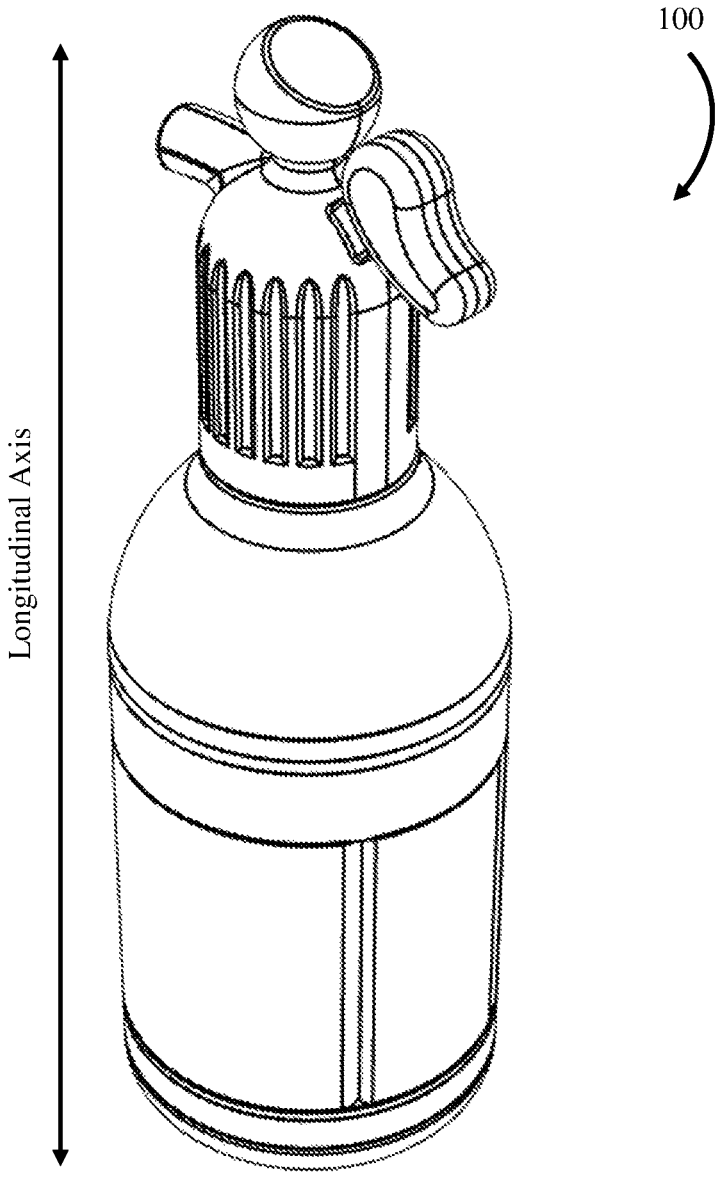
FIGS. 1A-1B show perspective, fragmentary perspective and exploded views of one example embodiment of the spray device with interchangeable cartridges.

COPYRIGHT NOTICE: A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. The following notice applies to any software and data as described below and in the drawings hereto: Copyright © 2019, Paul Sung Ventresca LLC, All Rights Reserved.

Spray devices and methods of use will now be described in detail with reference to the accompanying drawings. It will be appreciated that, while the following description focuses on a system that can be used to deliver fluids such as fragrances, the systems and methods disclosed herein have wide applicability. For example, the spray device described herein may be readily employed with sprays for skin products, hair care products, fertilizers, essential oils, cooking fluids beverages or chemicals. Notwithstanding the specific example embodiments set forth below, all such variations and modifications that would be envisioned by one of ordinary skill in the art are intended to fall within the scope of this disclosure.

The Technical Problem

The spray device disclosed addresses the technical problem of how to integrate, into a small handheld form factor like a bottle, components that allow for the simple changing of fluid contents to allow a user to change multiple fluids delivered by a spray device. In particular, the problem presented is how to allow this interchangeable dispensing to include the changing and securing of both a fluid concentrate and a fluid dilute and allow them to be dispensed and mixed at the proper ratio. The problem is particularly evident when the size of the spray device is small such as less than about 10.0 inches or less than about 5.0 inches in overall height.

The Technical Solution

The disclosed spray device addresses the technical problem presented by providing interchangeable fluid containers into a spray device that has reusable components such as the piston assembly and other device components. The secure coupling of the cartridges with other elements of the spray device allows small amounts of fluid to be easily interchanged by changing cartridges. Furthermore, the spray device ensures a proper mixing ratio of the fluid by having fluid delivery conduits that are dimensioned to automatically deliver the fluids at the proper ratio.

Differences from Prior Art

The disclosed spray device addresses shortcomings in the prior art by providing a handheld device configured to allow for easy interchange of different fluid cartridges while also securely coupling these cartridges into the device. For fluids that are typically stored and dispensed in small amounts, the fluid cartridges to hold these fluids may be small. With a small fluid cartridge design, the interchange of cartridges needs to be simple so that they can be properly secured. For example, it may be difficult to interchange small cartridges if the coupling requires a threaded coupler on the cartridge. In some embodiments, the disclosed spray device does not need to couple the fluid cartridges to the manifold with threaded fittings. The small design of the spray device is also beneficial in that it is creates less waste and is light weight for shipping the device and shipping fluid cartridges.

Figure 1B:
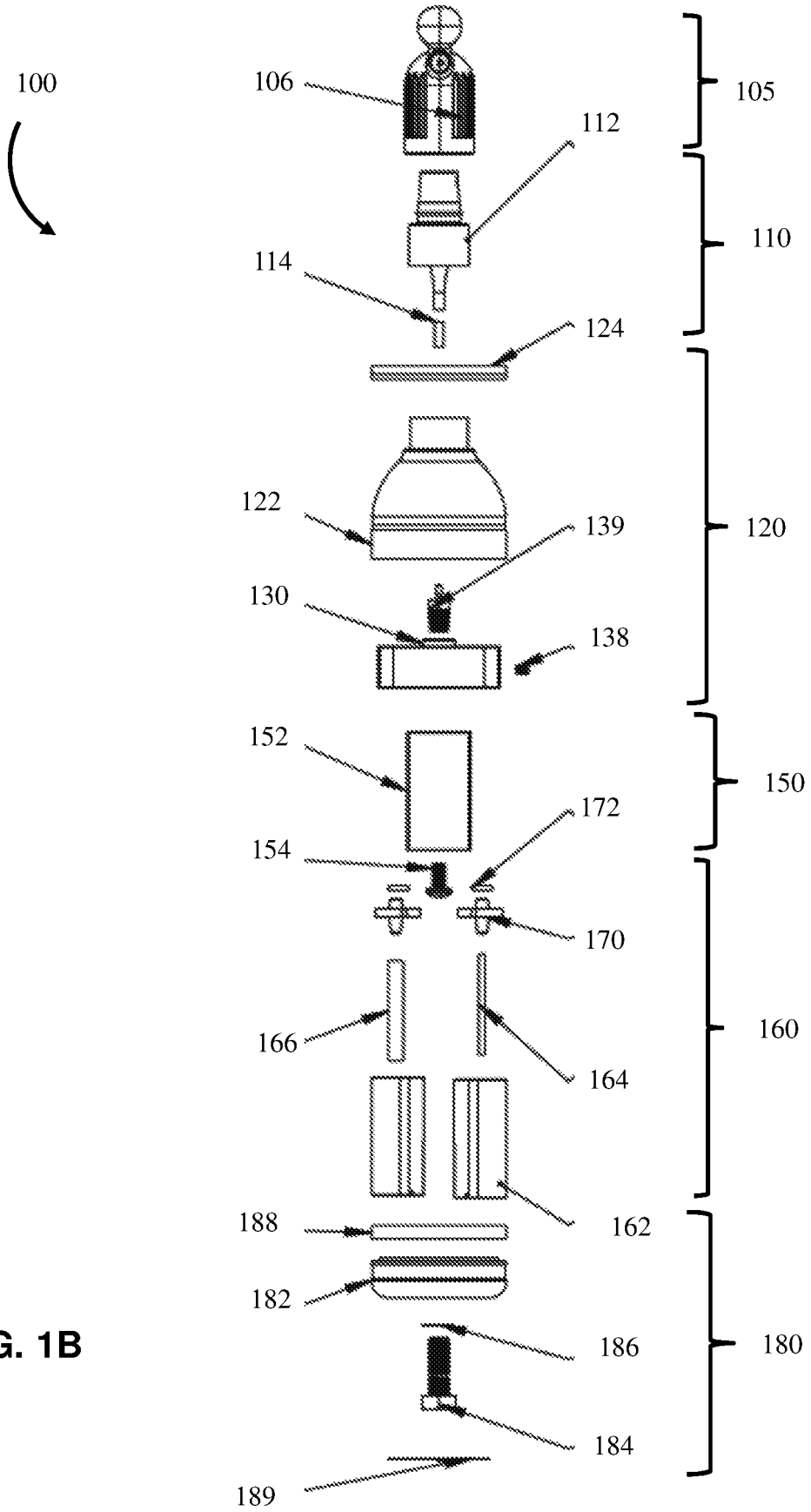

One Example Embodiment of the Spray Device with Interchangeable Cartridges:

For illustration purposes and not for limitation, one example embodiment of the spray device with interchangeable cartridges is shown in FIGS. 1A-1B.

Referring to FIG. 1B, an example embodiment of a spray device 100 is shown in an exploded view of the embodiment in FIG. 1A. The spray device 100 includes a top section 120 and a cartridge section 160. The embodiment shown also includes a middle section 150, a cap section 105, a piston section 110 and a bottom section 180.

The top section 120 generally provides the fluid mixing components from the cartridge section 160 to the piston section. The cartridge section 160 generally provides the storage compartment or reservoir for the fluid to be dispensed through the piston section 110. The middle section 150 generally provides additional support for other elements of the spray device 100 such as coupling elements to engage with element of the cartridge section 160, the bottom section 180 and the top section 120. The bottom section 180 generally provides a base for the spray device 100. The piston section 110 generally provides the pumping mechanism 112 and coupling tubes 114 to deliver fluids from the middle section 150 to the outside of the spray device. The cap section 105 generally covers the pumping trigger of the pumping mechanism 112.

Referring to FIG. 1B in more detail, the top section 120 may comprise a manifold 130, a top 122, a top band 124, a tube fitting 139 and one or more set screw 138. The middle section 150 may comprise a middle support 152 and a coupler 154. The cartridge section 160 may comprise one or more cartridge 162, a concentrate tube 164, a dilute tube 166, a cartridge lid 170, and a sealing ring 172. The bottom section 180 may comprise a bottom 182, a bottom band 188, a locking ring 186, a coupler 184 and a label 189. The cap section 105 may comprise a cap 106. The piston section 110 may comprise a pumping mechanism 112 and a coupling tube 114.

The different section components of the spray device may be made from any material suitable for its purpose. For example only and not for limitation, section components may be made from: plastics such as high temperature plastics (HTP), Acrylonitrile Butadiene Styrene (ABS), polyethylene, polycarbonates, polypropylene, nylon and acrylics; metals such as aluminum; and other materials such as milled wood. Example materials for embodiments of section components are also provided in this description.

The different section components of the spray device may be made to any dimension suitable for the purpose of the spray device. Within this description and the accompanying drawings, illustrative dimensions have been provided as example only and not as a limitation. In the drawings, noted dimension are in inches. Some embodiments of the spray device have an overall height dimension of less than about 10.0 inches and some have a height less than about 5.0 inches.

The Top Section

An example embodiment of the top section for a spray device is shown in FIGS. 2A-2F. The top section generally provides the fluid mixing components from the cartridge section to the piston section. The fluid mixing components are generally provided by the manifold. The top section may also comprise a top and a top band.

Figure 2A:
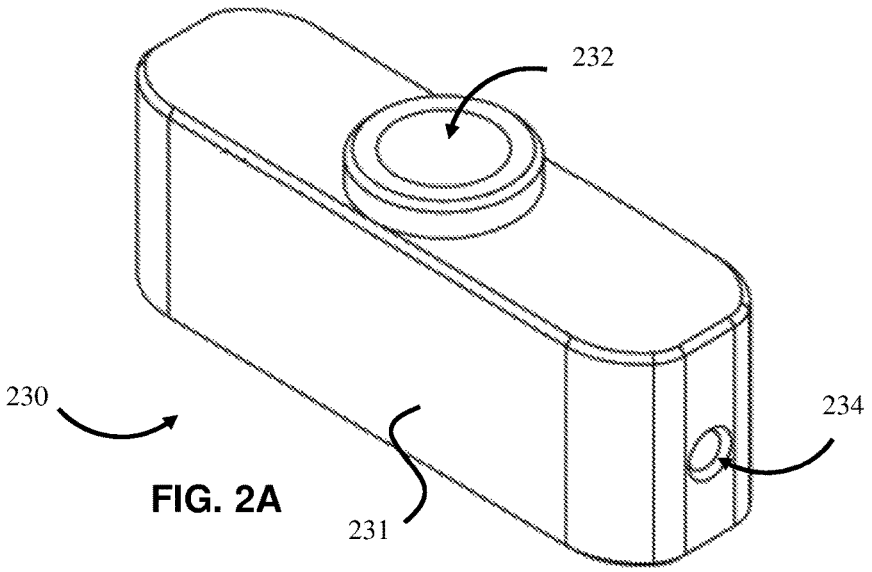
FIGS. 2A-2F show a perspective, side, front, top, bottom view and a sectional view of an example embodiment of the manifold.
Figure 2B:
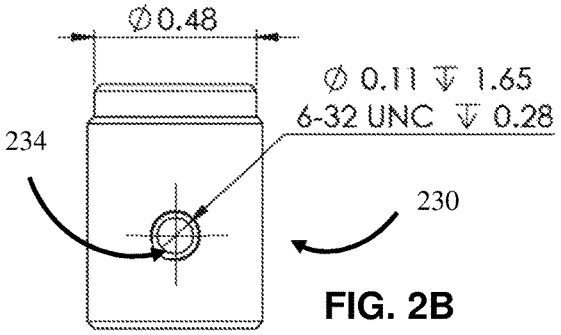
Figure 2C:
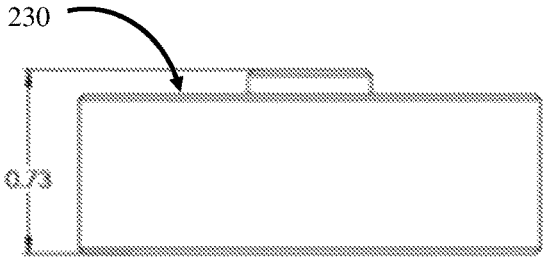
Figure 2D:
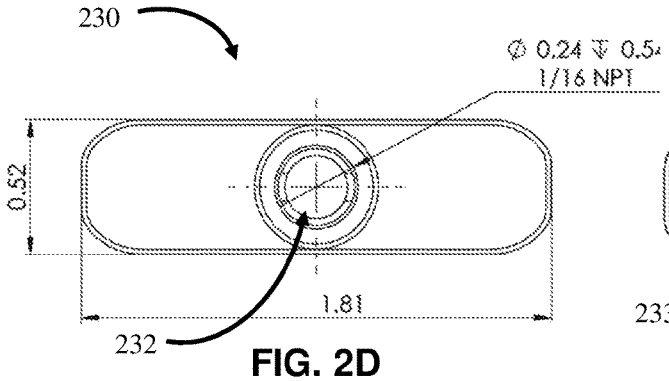
Figure 2E:
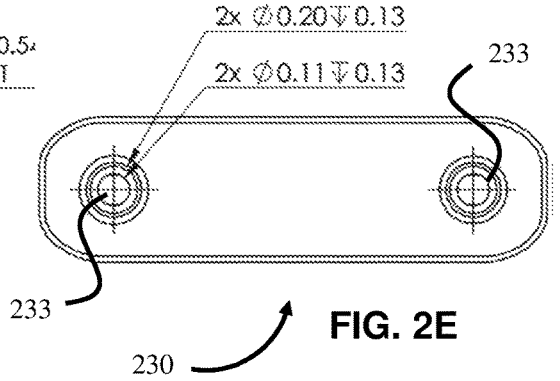

As shown in FIGS. 2A-2F, the manifold 230 generally provides the fluid delivery and mixing components from the cartridge section to the piston section. Referring to FIG. 2A, the manifold 230 generally comprises a manifold body 231, a tube fitting recess 232, a cartridge lid engagement area 233 (see FIG. 2E) and an internal conduit 235 (see FIG. 2F) providing for fluid communication between cartridges and the tube fitting. FIG. 2B shows an exit 234 of the internal conduit from the side of the manifold 230. FIG. 2D shows a top view of the manifold 230 and the tube fitting recess 232. FIG. 2E shows a bottom view of the manifold 230 and two cartridge lid engagement areas 233 configured to receive a fitting from the cartridge lid to allow fluid to flow into the internal conduit of the manifold 230.

Figure 2F:
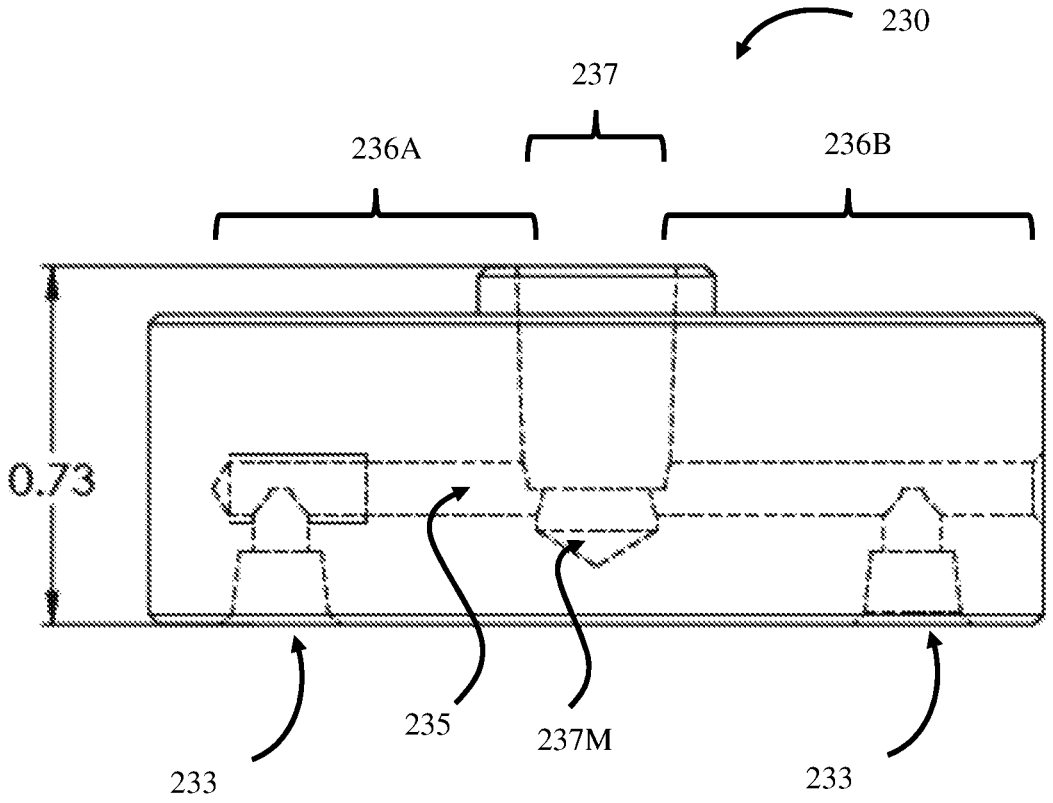

Referring to FIG. 2F, the internal conduit 235 provides the fluid communication between the cartridge lid and the piston section. The internal conduit 235 may be any shape to allow fluid to be communicated from the cartridge lid to the piston section of the spray device. In the example shown, the internal conduit 235 comprises a horizontal through hole extending between the cartridge lid engagement areas 233. The horizontal through hole should be closed to the piston section and the cartridge lid in operation and may be capped on one or both ends by a plug such as a set screw. The internal conduit 235 can be defined to have a fluid concentrate conduit 236B, a fluid dilute conduit 236A and a mixing section 237. The mixing section 237 may also specifically have a mixing pool 237M which is generally a recess within the conduit that is lower than other sections of the internal conduit 235 so that fluid will pool there if the spray device is held generally level. The fluid concentrate conduit 236B allows the fluid concentrate to be received from the orifice in the fluid concentrate container and flow to the mixing section 237. Functionally, the internal conduit 235 allows the fluid within each cartridge to be drawn upwards into the manifold 230 and combined at the mixing section 237.

In some embodiments, the ratio of mixing of the fluid concentrate and the fluid dilute within the internal conduit is defined the inside diameter of the fluid concentrate conduit 236B and the fluid dilute conduit 236A. In these embodiments, the inside diameter of the concentrate conduit 236B defines a constricted concentrate conduit area and the inside diameter of the fluid dilute conduit 236A defines a constricted dilute conduit area and the ratio of the two constricted areas defines a ratio of mixing of the fluids. This ability to alter the ratio based on simple dimensions of spray device components such as the internal conduit allows manufacturers to easily make alternative configurations to suit user's needs.

The manifold 230 may also be constructed as separate components. For example, the manifold 230 may be made from a bottom half and a top half. In these embodiments, the components may be coupled together, for example by welding or an adhesive, to make the complete manifold.

As shown in FIGS. 2A-2F, in one example embodiment, the manifold 230 has a height of about 0.73 inches, a width of about 0.52 inches and a length of about 1.81 inches. In one example embodiment, the manifold 230 is made from ABS.

Figure 3A:
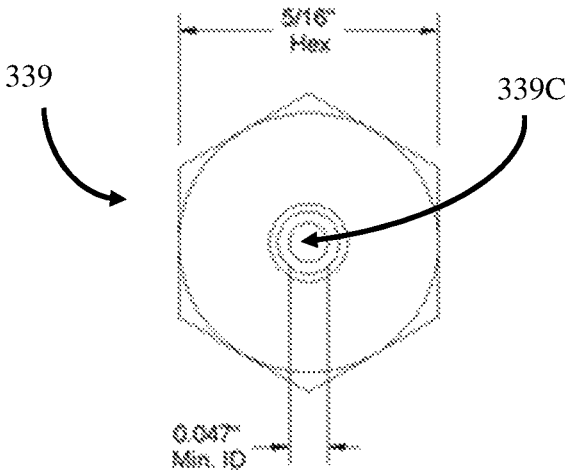
FIGS. 3A and 3B show a top and side view of a tube fitting.
Figure 3B:
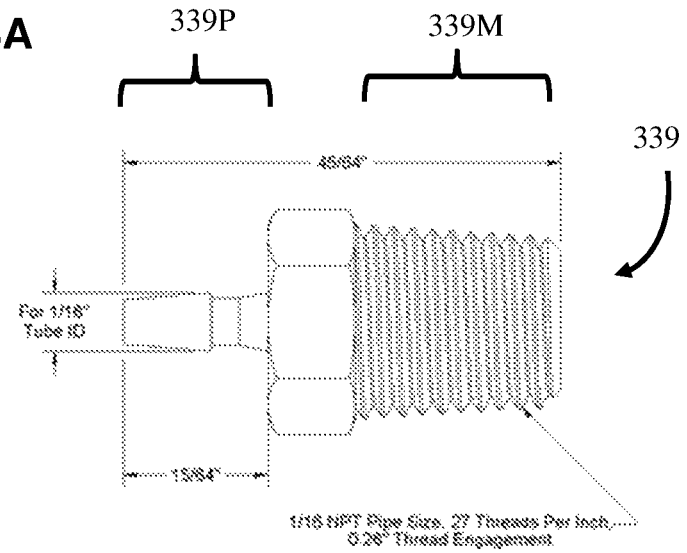

The manifold may further comprise a tube fitting to couple the manifold and elements of the piston section. Referring to FIGS. 3A and 3B, tube fitting 339 may be provided with a piston coupling section 339P and a manifold coupling section 339M. The piston coupling section 339P may be any type of coupling element that mates with the piston section and allows for fluid communication with the manifold internal conduit. In the example shown, the piston coupling section 339P comprises a form fitting that mates with a tube end from the piston section. The manifold coupling section may be any type of coupling element that mates with the manifold and allows for fluid communication with the piston section. In the example shown, the manifold coupling section 339M comprises a threaded fitting that mates with threads on the manifold. Fluid communication through the tube fitting 339 is provided by a through hole 339C that extends the internal conduit of the manifold into the piston section.

Referring now to FIGS. 4A-4D, the top section may comprise a top 422 defining a housing and coupling elements for the middle section and the piston section.

As shown, the top section may have a top 422 with a recess 424 to receive components from the piston section. The top 422 may also have an externally threaded neck 423 to mate with a correspondingly threaded mating end of the piston section.

Figure 4A:
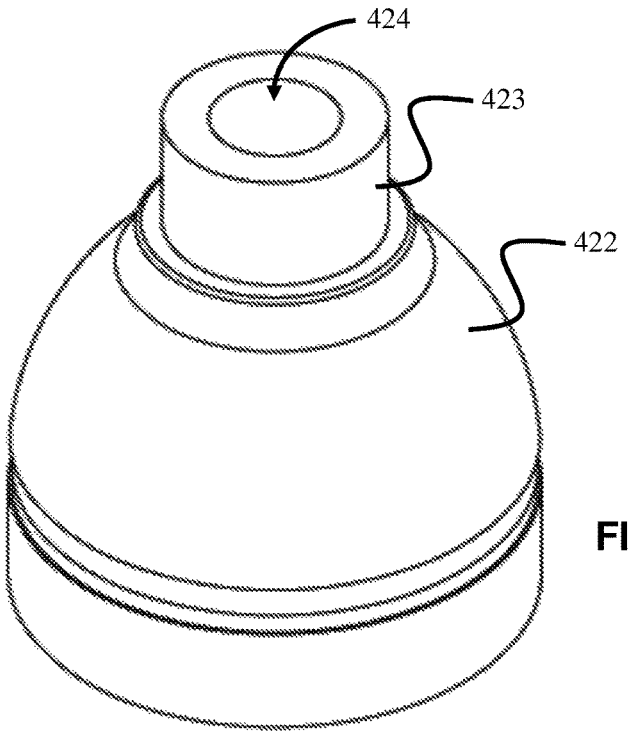
FIGS. 4A-4E show perspective, top, side, bottom and cross section views of an example embodiment of the top of the spray device with interchangeable cartridges.
Figure 4B:
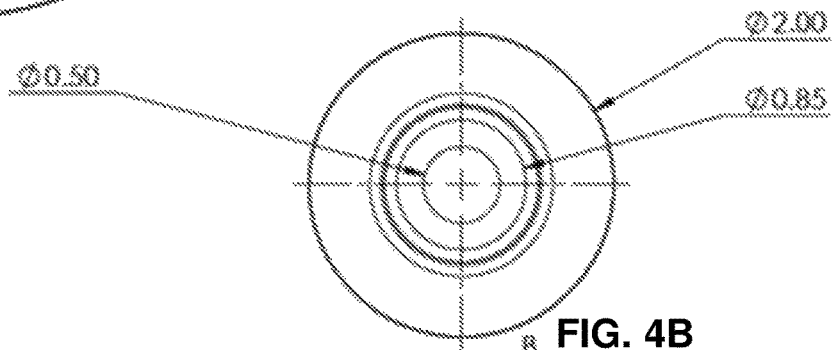
Figure 4C:
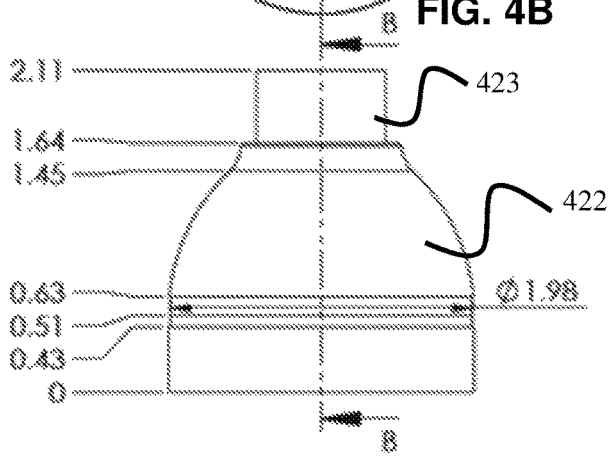
Figure 4E:
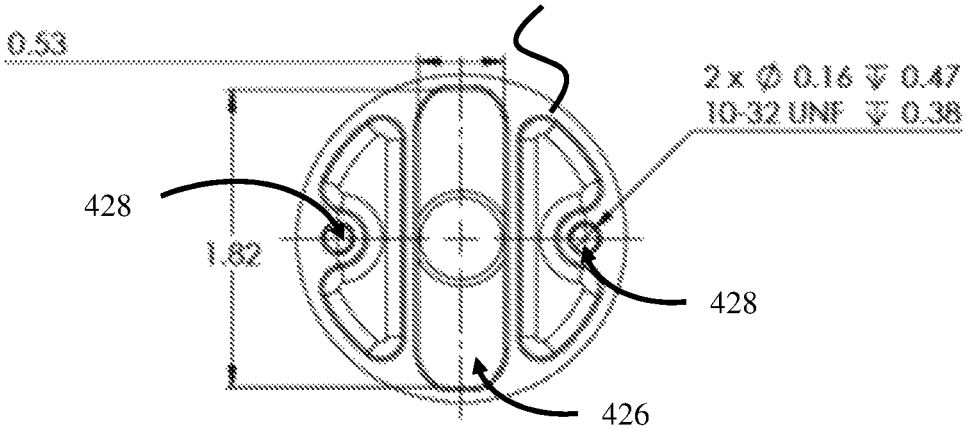
Figure 4D:
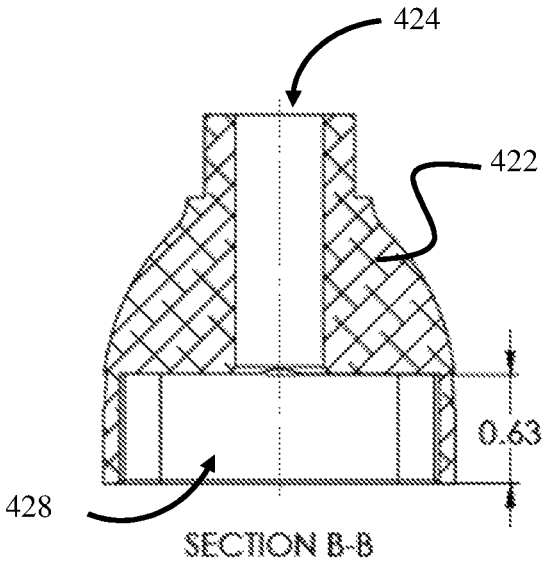

As shown in FIG. 4D, the top 422 may also have a manifold recess 426 to receive components from the manifold section.

The top section may also have a coupling means to couple elements from the middle section. For example, and not for limitation, referring to FIG. 4E, the top 422 shown includes holes 428 for a coupler such as a screw to be received from the middle section to secure the middle support to the top 422.

In one example embodiment, as shown in FIGS. 4A-4D, the top 422 has a height of 2.11 inches and a width of 2.00 inches.

The top may be made from any suitable material. In one example embodiment, the top 422 is made from ABS.

Figure 5:
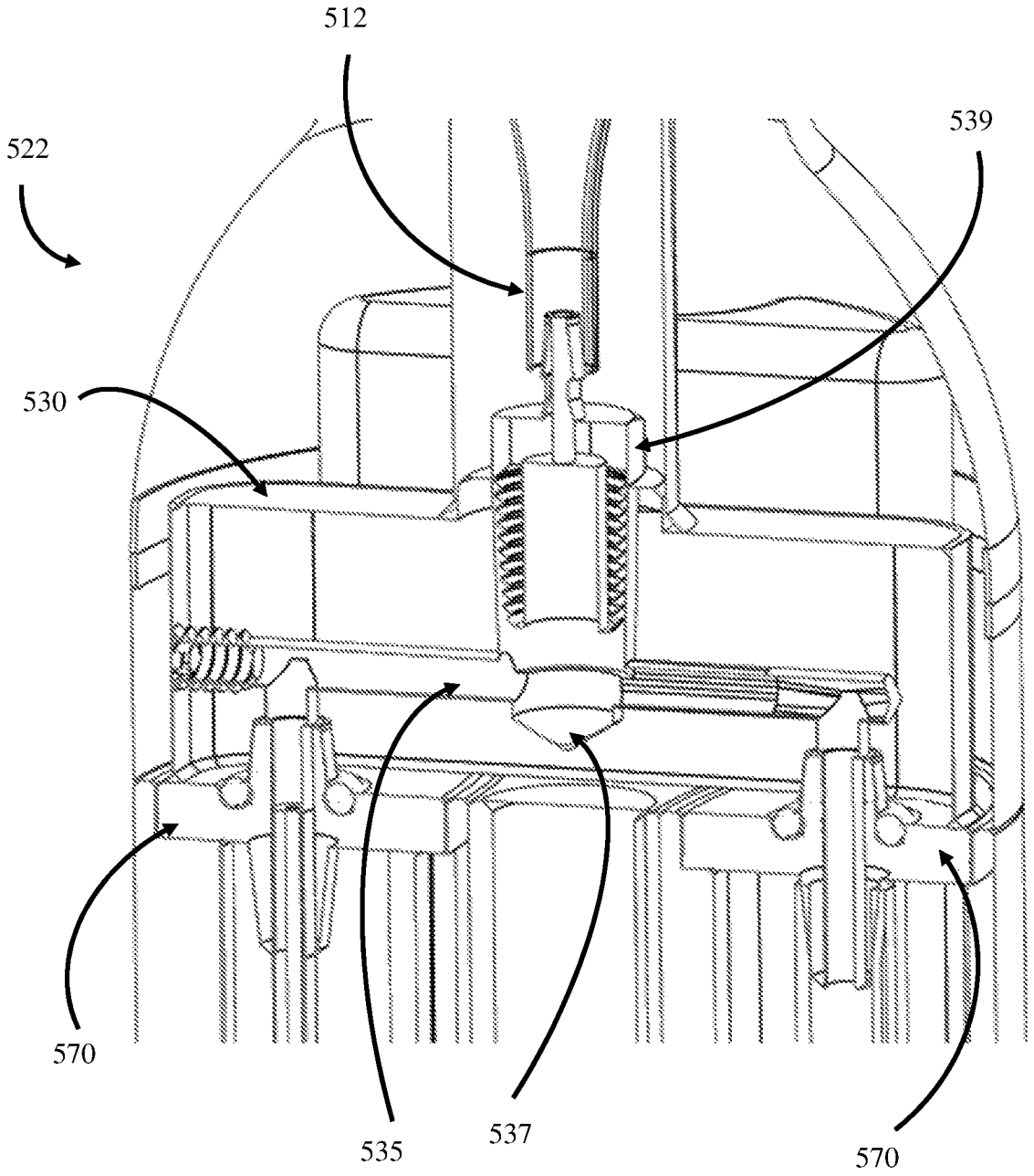
FIG. 5 shows a sectional view of another example embodiment of the top section of the spray device.

FIG. 5 shows another embodiment of the top 522 with the bottom of the pumping mechanism 512, tube fitting 539, manifold 530, internal conduit 535 and cartridges lids 570. The manifold 530 is designed to provide support to tube fitting 539 in the direction of operation to prevent jamming of the piston section from occurring. As shown, fluid is drawn up through openings in the cartridge lids 570, into the internal conduit 535 and converges together at mixing section 537, flows through the tube fitting 539 and into the coupling tube 514 to be dispensed by the piston.

Figure 6A:
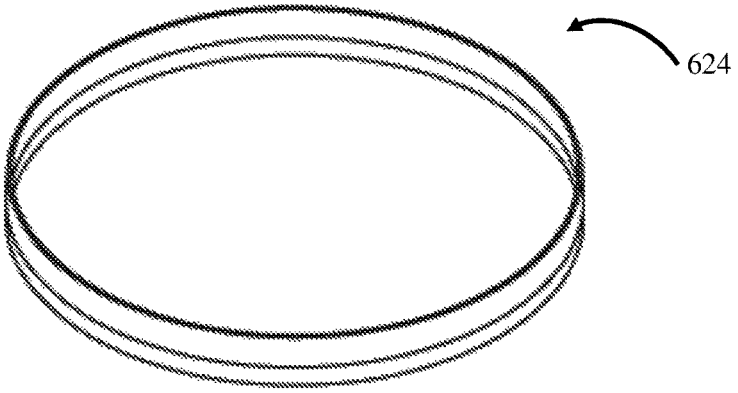
FIGS. 6A-6C show a perspective, top and side view of an example embodiment of the top band of the spray device.
Figure 6B:
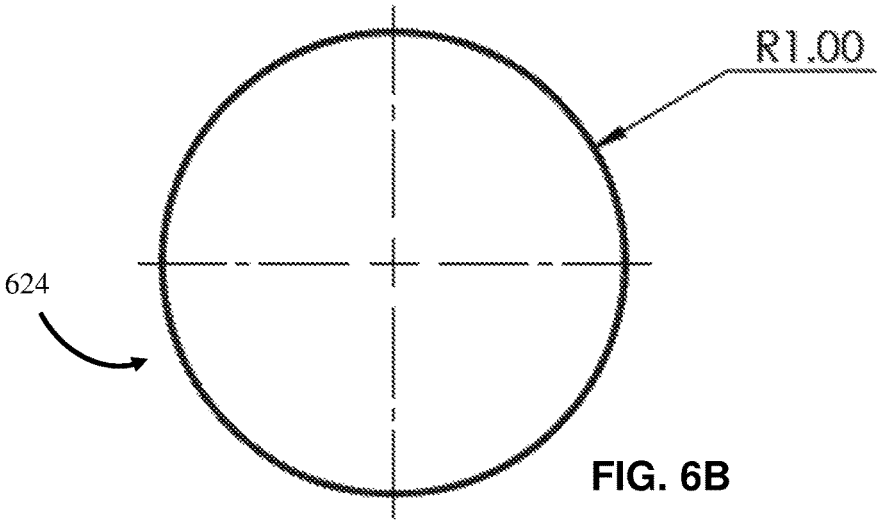
Figure 6C:
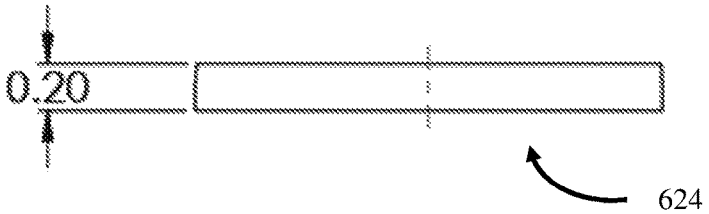

In some embodiments, the top section further comprises a top band. Referring to FIGS. 6A-6C, a top band 624 is shown to be fitted around the exterior of the top. In one example embodiment, the top band 524 has a height of about 0.20 inches and a radius of about 2.00 inches which wraps around the exterior top section of the device.

The Middle Section

Figure 14A:
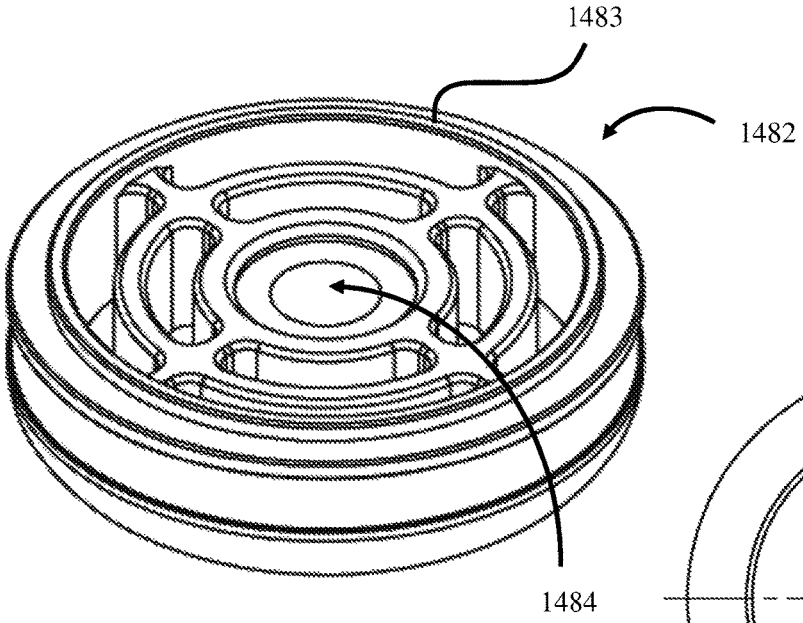
FIGS. 14A-14D show a perspective, bottom, top and side view of the bottom of the spray device.

In some embodiments, the spray device further comprises a middle section. The middle section generally provides additional support for other elements of the spray device such as coupling elements to engage with element of the cartridge section, the bottom section and the top section. An example embodiment of the middle section of a spray device is shown in FIGS. 7A-7G. The middle section may comprise a middle support 752 configured to engage with and support elements of the cartridge section. As shown, the middle support 752 may include a middle shoulder 758 to engage a mating shoulder recess in a cartridge body. The middle shoulder 758 provides additional stability for the cartridge body in addition to the stability provided from the cartridge lid engaging recesses in the manifold. The middle section may also have one or more bottom channels 753 to engage one or more raised mating rings in the bottom section (see FIG. 14A). The mating of the bottom channels 753 with the mating rings of the bottom section provide additional stability for the middle section when it and the cartridge body are coupled to the bottom and the top sections.

Figure 7A:
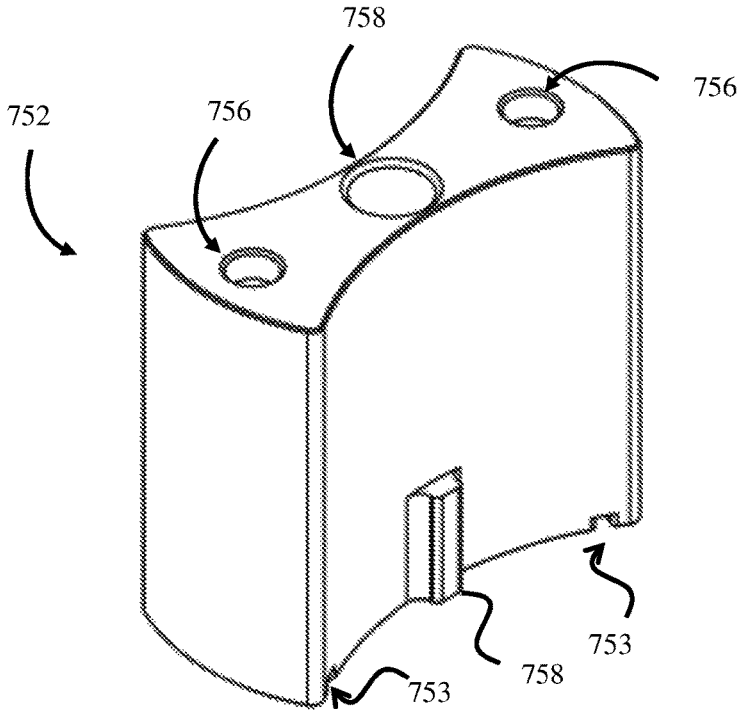
FIGS. 7A-7E show a perspective, top, bottom, sectional and side view of an example embodiment of the middle of the spray device with interchangeable cartridges.
Figure 7B:
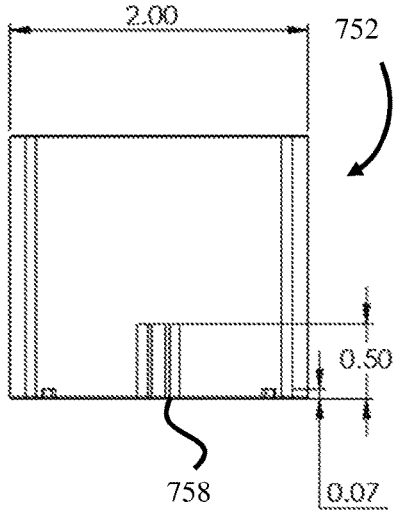
Figure 7C:
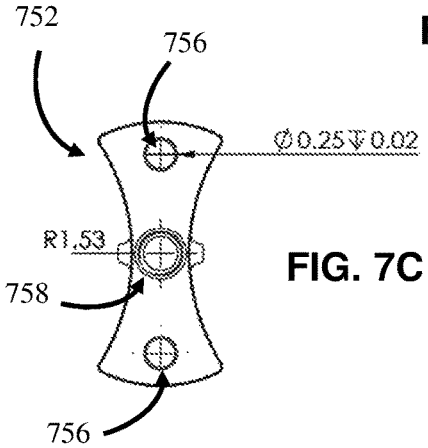
Figure 7D:
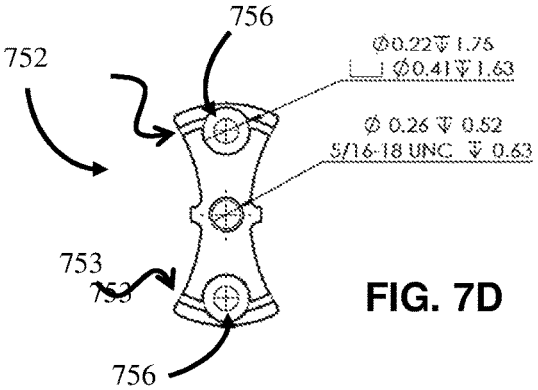
Figure 7E:
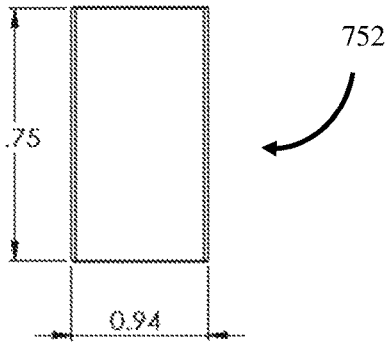
Figure 7F:
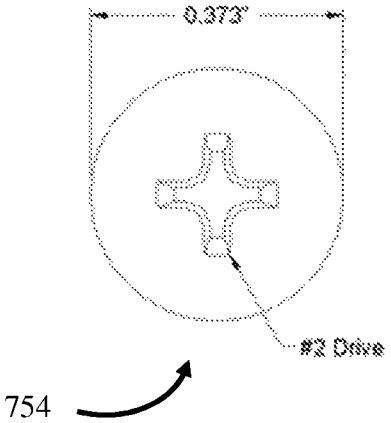
FIGS. 7F and 7G show a top and side view of a coupler.
Figure 7G:
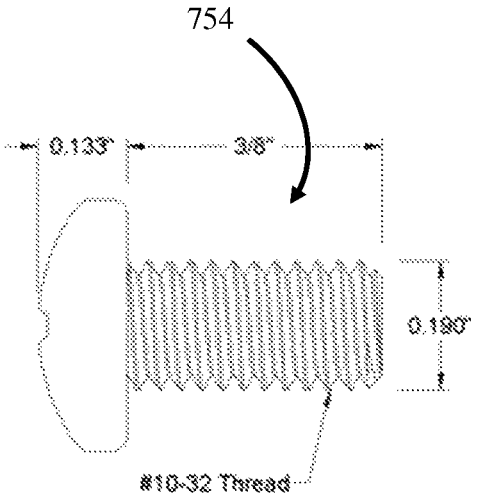

The middle section may also include a coupler to couple the middle support 752 to the top section. Referring to FIGS. 7F and 7G, one embodiment of the coupler 754 may be a screw to fit through the hole 756 in the middle support 752 and couple it to mated holes in the top section.

In one example embodiment, as shown in FIGS. 7A-7E, the dimensions of the middle section comprise a height of about 0.75 inches, a width at its widest point of about 0.94 inches and a length of about 2.0 inches.

The middle section and middle support may be made from any suitable material. In one example embodiment, the middle section is made from ABS.

Figure 8:
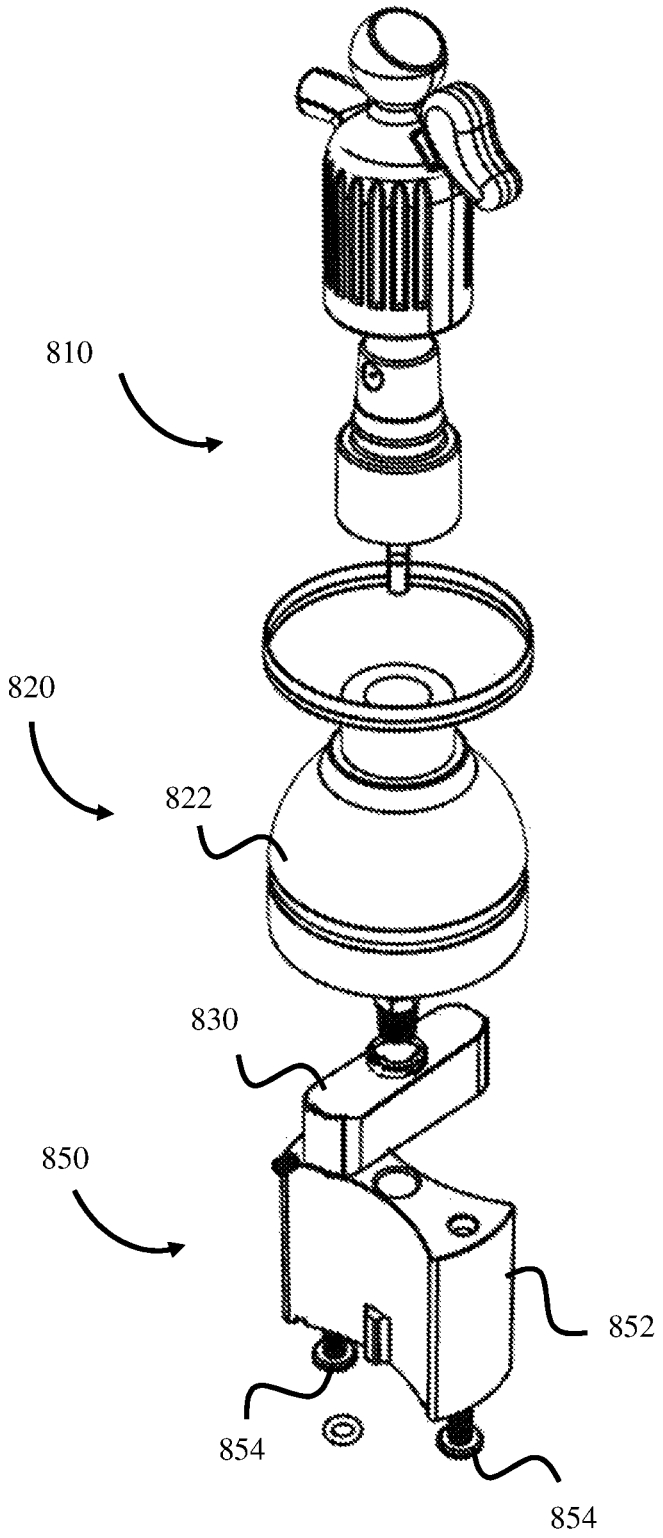
FIG. 8 shows a fragmentary perspective showing an example embodiment of the top to middle assembly of the spray device.
Figure 9A:
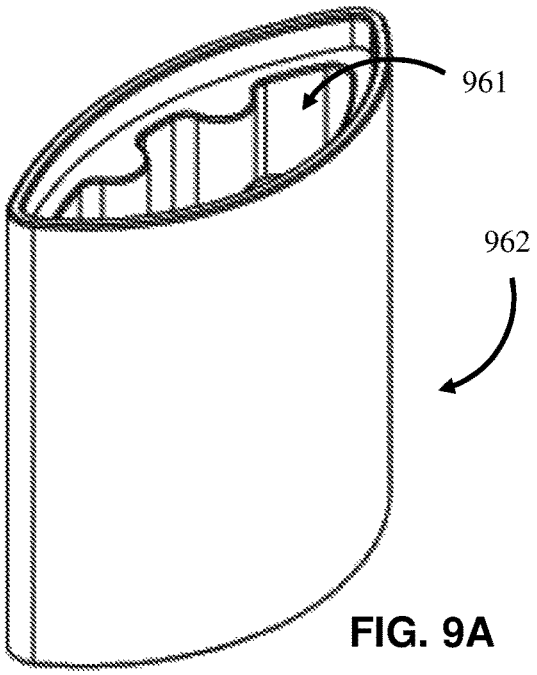
FIGS. 9A-9F show a perspective, top, bottom, sectional, from and side front view of an example embodiment of the cartridge within the spray device.
Figure 9B:
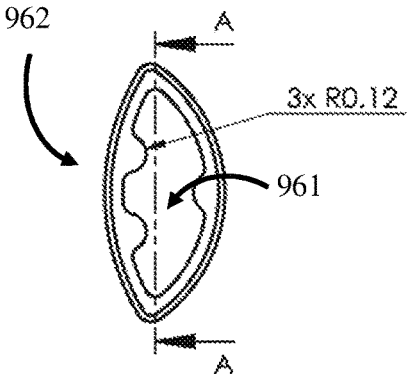
Figure 9C:
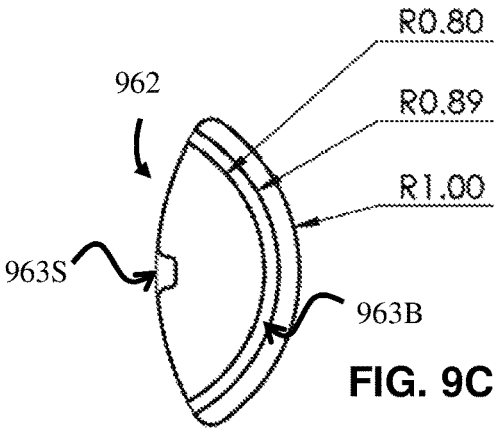
Figure 9D:
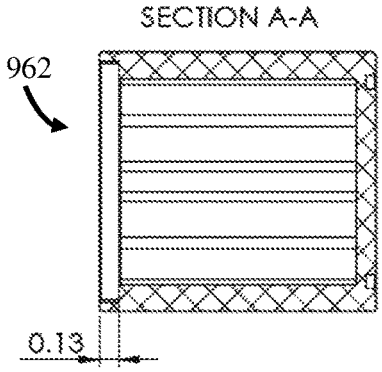
Figure 9E:
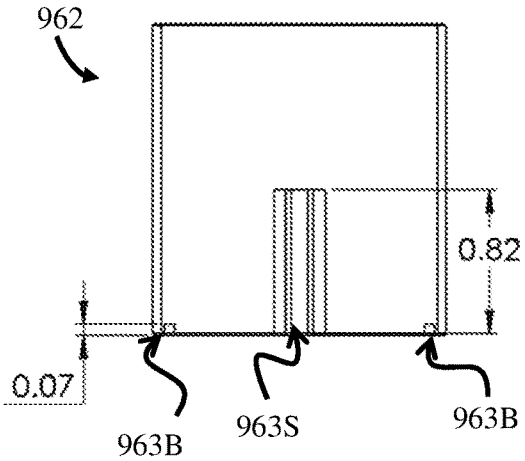
Figure 9F:
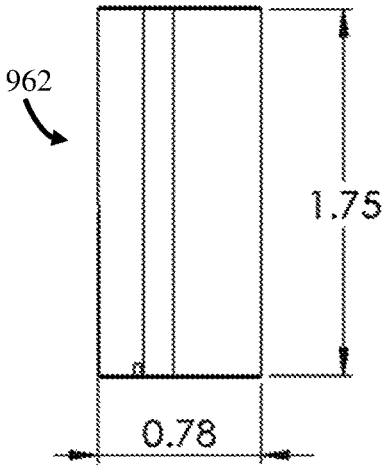

FIG. 8 shows an example embodiment of the top section 820 and the middle section 850 of the spray device. Piston section 810, which may be a stock spray pump mechanism, is also shown. This pump mechanism draws the fluids from the internal conduit of the manifold 830, allowing the release of the fluid from the pump mechanism. As shown, the top section 820 and the middle section 850 are connected by fitting the manifold 830 into the top 822 and securing it by coupling the middle support 852 to the top 822 with screws 854.

The Cartridge Section

In some embodiments, the spray device further comprises a cartridge section. The cartridge section generally provides the storage compartment to hold the fluid to be dispensed through the spray device. The cartridge section may comprise one or more cartridge body, one or more fluid tubes and one or more cartridge lids. In one embodiment, the cartridge section comprises a cartridge for a fluid concentrate and a cartridge for a fluid dilute.

Referring to FIGS. 9A-9F, multiple views of an example embodiment of a cartridge body 962 are shown. As shown in the FIGS. 9A and 9B, the cartridge body 962 has walls and a bottom defining a reservoir 961 to hold fluid. The fluids, whether the fluid concentrate or the fluid dilute are held in the reservoir 961 to be dispensed by other elements of the spray device. As shown in the FIGS. 9C and 9E, the bottom of the cartridge may have a shoulder recess 963S to engage with the middle shoulder of the middle support. The bottom of the cartridge may also have one or more bottom channels 963B to engage with a raised mating ring of the bottom section (see FIG. 14A). The interior walls of the cartridge body may have ribs extending longitudinally to help provide some additional rigidity to the cartridge body.

The cartridge body may be made to any dimensions that can retain a suitable amount of fluid and engage the other spray device elements. In one example embodiment, the cartridge body has a width of about 0.79 inches and a height of about 1.74 inches.

The cartridge body may be made from any suitable materials. In one example embodiment, the cartridge body 62 is composed of an acrylic.

Figure 10A:
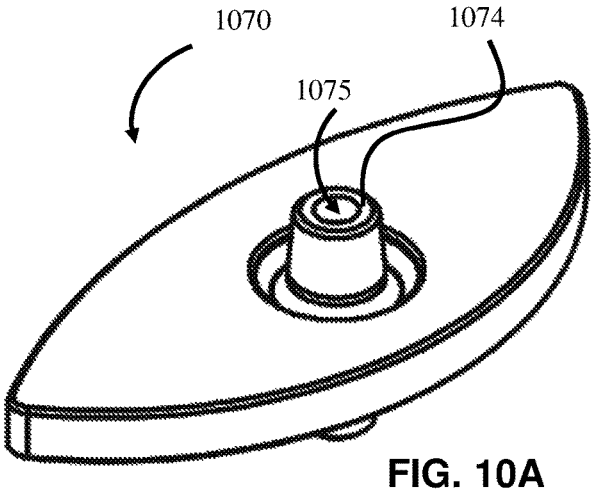
FIGS. 10A-10D show a perspective, top, bottom and front view of an example embodiment of the cartridge lid.
Figure 10B:
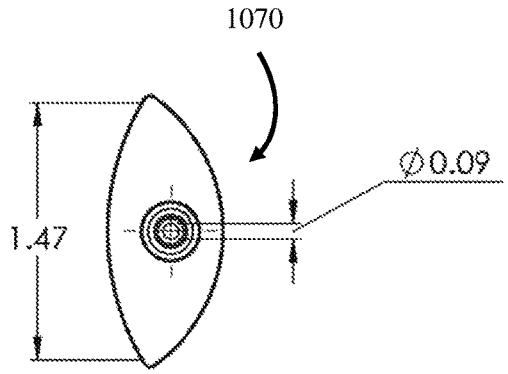
Figure 10C:
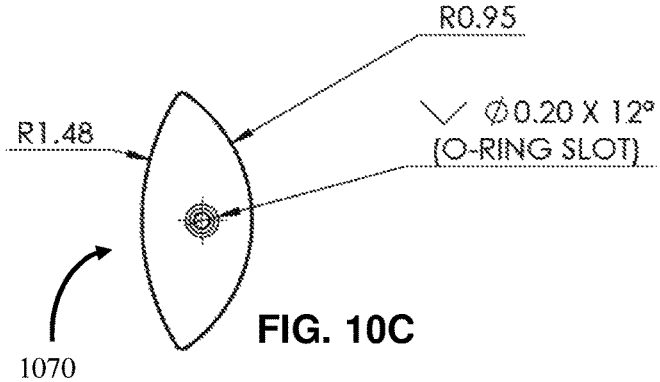
Figure 10D:
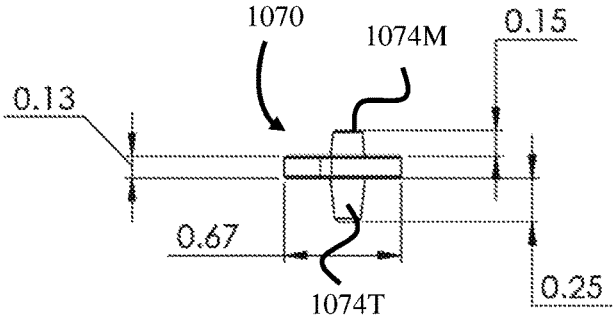

The cartridge section may also comprise a cartridge lid. Referring now to FIGS. 10A-10D, multiple views of example embodiment of a cartridge lid 1070 are shown. The cartridge lid 1070 generally functions to cover the reservoir of the cartridge body and provide a conduit between the reservoir and the internal conduit of the manifold. The cartridge lid 1070 comprises a lid coupler 1074 defining a lid conduit 1075 providing a conduit to the reservoir of the cartridge body. FIG. 10B shows an example embodiment of a lid conduit 1075 for the fluid concentrate cartridge. In some embodiments, the size of the lid conduit 1075 may be configured to cooperate with the size of the tube extending into the cartridge body to ensure the ratio of fluid dilute and fluid concentrate are maintained. For example, as shown in FIG. 10B, the lid conduit 1075 can fit the outside diameter of a tube for the fluid concentrate (see FIGS. 11A-11C). And, for example, the size of the lid conduit 1075 for the tube for the fluid dilute may be the same as the internal diameter of the tube or it may be larger or it may be smaller (e.g., to define a constricted dilute conduit area). As shown in FIG. 10D, the lid coupler 1074 may comprise (1) a manifold coupler 1074M configured to couple or mate the cartridge lid 1070 to the manifold at the cartridge lid engagement area and (2) a tube coupler 1074T configured to mate the cartridge lid 1070 to a tube extending into the cartridge body.

In some embodiments, to reduce the risk of back flow of fluids from the internal conduit 235 into the fluid cartridges, the dimensions of the manifold coupler 1074M are such that when it is coupled with the manifold, the manifold coupler 1074M or the tube extends into the internal conduit enough so that fluid retained in the conduit after the pump is actuated does not flow back through the manifold coupler 1074M and into the fluid reservoir.

In some embodiments, the lid coupler 1074 or either of the manifold coupler 1074M or the tube coupler 1074T may further include a one-way restrictor element to provide the function of a one-way check valve and restrict flow of fluids back into the reservoirs.

The cartridge lid 1070 may have any shape to close the top of the cartridge body. In one example embodiment, cartridge the lid 1070 has a length of about 1.47 inches and a width of about 0.67 inches.

The cartridge lid 1070 may be made from any suitable material. In one example embodiment, the cartridge lid 1070 is made from a clear acrylic.

The cartridge section may also comprise a tube extending into the reservoir formed by the cartridge body and into the retained fluid. The tube couples to the tube coupler to mate the tube to the cartridge lid and generally facilitates the transfer of fluid (e.g., the unscented base or the concentrated fragrance) from the cartridge reservoir through the top section to the piston section an out of the spray device. The tubes may be made from any suitable material. In one embodiment, the tubes are made from Tygon® brand flexible polymer tubing as marketed and sold by the Saint-Gobain Corporation in Malvern Pa.

Figure 11A:
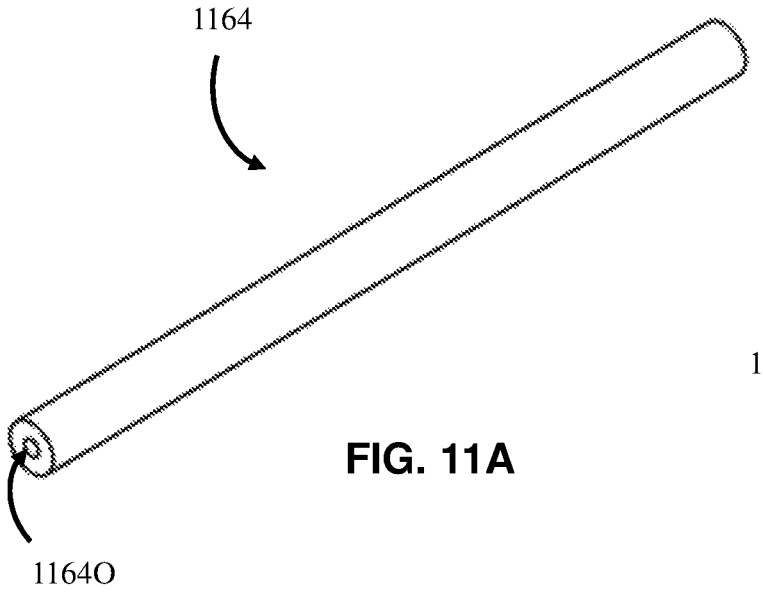
FIGS. 11A-11C show a perspective, side and top view of an example embodiment of the tube carrying the fluid concentrate within the spray device.
Figure 11B:
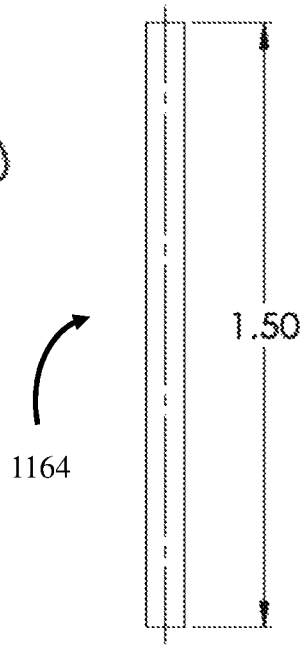
Figure 11C:
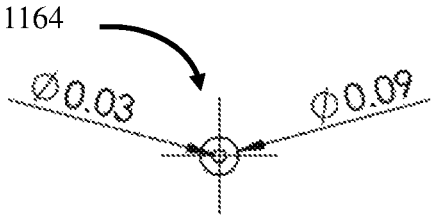

Referring to FIGS. 11A-11C, one example embodiment of a tube 1164 is shown. The example embodiment shown has an internal conduit that extends the internal conduit of the manifold and middle section to the fluid in the cartridge. The internal diameter of the tube 1164 may be designed to create a specific ratio with the internal diameter of the other tube in the other cartridge to define the specific ratio that fluids are pulled from both cartridges. The tube 1164 shown is an example of a suitable tube for the cartridge configured to retain the fluid concentrate.

The dimensions of the tube 1164 may be any dimension that allows the tube to reach near the bottom of the cartridge when engaged with the tube coupler of the cartridge lid and allow fluid to flow from the cartridge to the manifold. In one example embodiment, the length of the tube 1164 is about 1.50 inches, the outside diameter is about 0.09 inches and the diameter of the opening 11640 is about 0.03 inches.

Figure 12A:
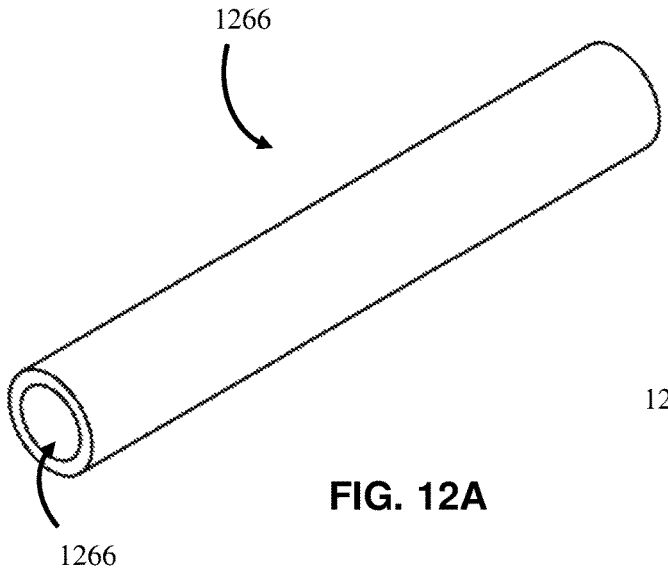
FIGS. 12A-12C show a perspective, side and top view of an example embodiment of the tube carrying the fluid dilute within the spray device.
Figure 12B:
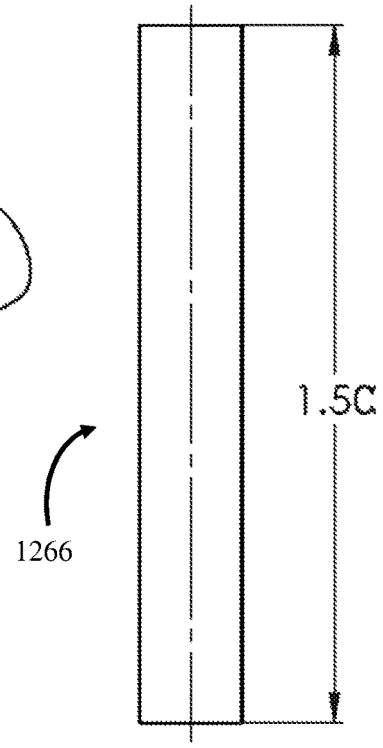
Figure 12C:
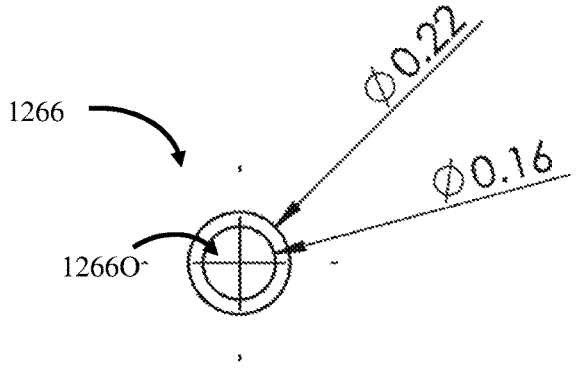

Referring to FIGS. 12A-12C, one example embodiment of a tube 1266 is shown. The example embodiment shown has an internal conduit that extends the internal conduit of the manifold and middle section to the fluid in the cartridge. The internal diameter of the tube 1266 may be designed to create a specific ratio with the internal diameter of the other tube in the other cartridge to define the specific ratio that fluids are pulled from both cartridges. The tube 1266 shown is an example of a suitable tube for the cartridge configured to retain the fluid dilute.

The dimensions of the tube 1266 may be any dimension that allows the tube to reach near the bottom of the cartridge when engaged with the tube coupler of the cartridge lid and allow fluid to flow from the cartridge to the manifold. In one example embodiment, the tube 1266 has a length of about 1.5 inches, and outside diameter of about 0.22 inches and a diameter of opening 12660 is about 0.16 inches.

In some embodiments, the ratio of mixing of the fluid dilute and the fluid concentrate within the internal conduit is defined by the ratio of the inside diameter of the two tubes. In these embodiments, the inside diameter of the tube communicating the fluid concentrate defines a constricted concentrate conduit area and the inside diameter of the tube communicating the fluid dilute a constricted dilute conduit area and the ratio of the two constricted areas defines the ratio of mixing of the fluids. For example, and not for limitation, if the internal diameter of the tube communicating the fluid dilute is about 0.166 inches and the internal diameter of the tube communicating the fluid concentrate is about 0.031 inches, the ratio of dilute to concentrate is theoretically about 5:1. It is understood that in operation, actual dilution ratios may be affected by fluid friction within the tube and the viscosity of the fluids. In tests with the tube dimensions identified, pumping a propylene glycol dilute fluid and a isopropyl myristate concentrate fluid, resulted in a ratio estimated to be about 8.1:1. This ability to alter the ratio based on simple dimensions of spray device components such as the tube allows manufacturers to easily make alternative configurations to suit user's needs.

The ratio of fluid dilute to fluid concentrate may be of any ratio suitable to provide an acceptable fluid mixture from the spray device. In one example embodiment, the ratio of fluid dilute to fluid concentrate is controlled and defined by the ratio of the internal diameter of the tubes and is in a range of about 1:1 to 15:1, in some embodiments a range of about 4.4:1 to 13:1 and in some embodiments a range of about 5:1 to 10:1. In one embodiment, the ratio is about 8.1:1.

Figure 13A:
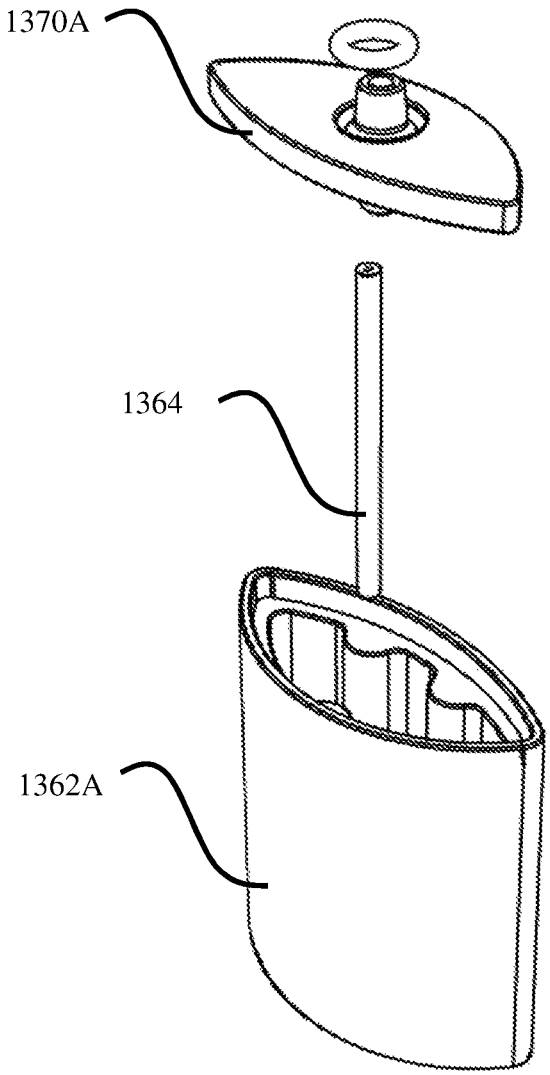
FIG. 13A shows a fragmentary perspective view of an example embodiment of a cartridge with lid and tube configured for use with the fluid dilute.
Figure 13B:
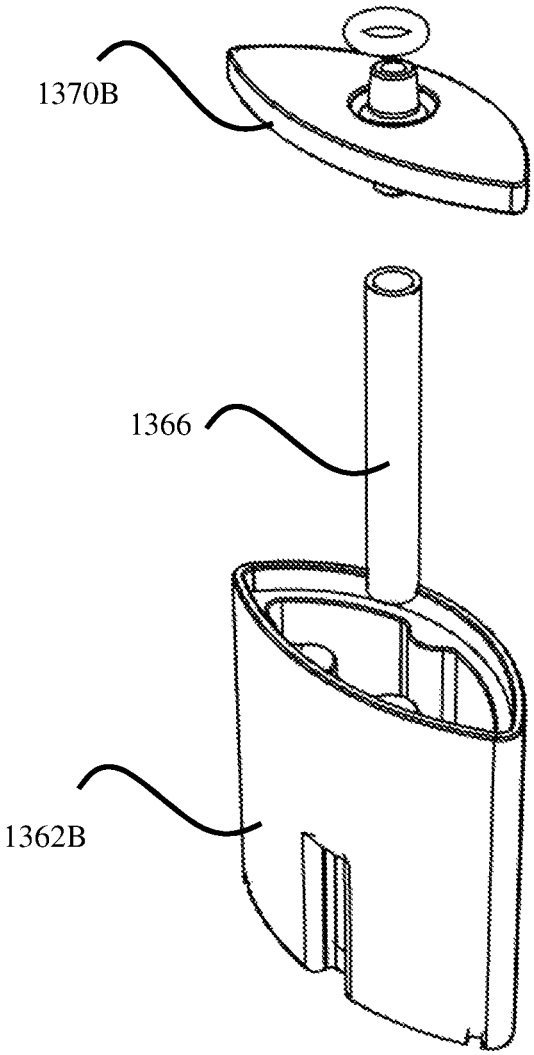
FIG. 13B shows a fragmentary perspective of an example embodiment of the cartridge with lid and tube configured for use with the fluid concentrate.

FIGS. 13A and 13B show a fragmentary perspective of a removable fluid concentrate cartridge and a removable fluid dilute cartridge containing a fluid concentrate tube 1364 and fluid dilute tube 1366, respectively. As shown, it is understood that the shaping on the cartridge and cartridge lid and the placement of the couple may be slightly different in the two cartridges to accommodate the overall design of the spray device. FIG. 13A shows a removable fluid concentrate cartridge having a cartridge body 1362A containing the fluid concentrate tube 1364 and intended to hold the fluid concentrate and couple with the tube coupler of the cartridge lid 1370A. FIG. 13B shows a removable fluid dilute cartridge having a cartridge body 1362B containing the fluid dilute tube 1366 and configured to hold the dilute fluid and couple with the tube coupler of the cartridge lid 1370B. The cartridge lids 1370A and 1370B may be welded or otherwise coupled to the top of the cartridge bodies 1362A and 1362B. The result is a cartridge configured to retain a fluid and allow the fluid to be dispensed from the cartridge through a conduit extending from the tube through the cartridge lid.

The cartridge lid may further comprise a sealing ring to fluidly seal the coupling of the cartridge to the top section.

The cartridge lid may also have a small venting hole to allow the fluid cartridge to receive air into the cartridge and occupy the volume vacated by the pumped fluid. In some embodiment, a 0.0625 inch diameter hole may be drilled in the top of each cartridge lid. When the fluid cartridges are inserted, this hole is not exposed to open environment, rather it is open to the inner part of the top section thereby minimizing the evaporative effect. Before the fluid cartridge is inserted, small covers such as adhesive foil could be applied over the hole to prevent any evaporation/leakage prior to use.

In the example embodiment of the cartridge lid 1070 shown in FIGS. 10A-10D, the cartridge lid 1070 provides a lid to a cartridge that is easily inserted securely into the manifold and easily removed with minimal risk of loss of fluid from the reservoir. This is accomplished without having to use more complicated coupling means like a treaded coupler between the manifold and the cartridge. When the spray device is used with expensive fluids such as perfumes, a secure seal of the cartridge to the manifold is helpful to reduce the amount of fluids that may escape from the cartridge such as through evaporation. Evaporation may alter the properties of the fluids and eventually detrimentally alter the ratio of fluids when the spray device is actuated. The secure insertion is assisted by a sealing ring that reduces the risk of fluid loss through the coupling of the cartridge lid with the manifold. The coupling with the sealing ring also secures the coupling of the cartridge lid and the manifold and limits movement of the cartridge in a direction parallel to a longitudinal axis of the spray device. Additionally, because the internal conduit of the manifold will retain fluid after actuation of the pump, fluid loss through evaporation from elements such as the pump, will be limited to loss of mixed fluid in the conduit. Furthermore, the use of one-way valves in the cartridge lid may also help prevent fluid loss from the fluid reservoirs.

Referring to FIGS. 9A-9F, the mating of the middle shoulder of the middle section and the shoulder recess further helps to allow the cartridge to be inserted securely into the manifold to minimize the risk of loss of fluid from the reservoir. The mating of these elements minimizes the movement of the cartridge when it is coupled to the manifold and helps ensure that the seal formed with the sealing ring is not compromised. This secure coupling is enhanced in embodiments where there is the additional mating of a bottom channels of the cartridge body with a raised mating ring on the bottom section.

Additionally, when the spray pump is used for fluids such as perfumes, the amount of fluid to be retained is expected to be less than for other applications. Because of this, the size of the cartridge may be small. With a smaller form factor for the cartridge, complicated means of securing the cartridge into the manifold may be impractical. The simple means of coupling with the pressure type fitting provided by the sealing ring together with the shoulder recess and bottom channel mating requires little manipulation and can be done with a small form-factor for the cartridge.

As discussed below, the use of the bottom section to further secure the cartridge section to the middle section also allows the cartridge to be inserted securely into the manifold to minimize the risk of loss of fluid from the reservoir.

Within the concentrate reservoir, various concentrate fluids may be held. For example only and not for limitation, concentrates may include essential oils (naturally-derived oils from plants), perfume oils (can be made from essential oils, or synthetic chemical blends), cannabidiol (CBD), beard oils or hair products. For example only and not for limitation, essential oils may comprise peppermint, lavender, lemon, rosemary, frankincense or lemongrass oils. For example only and not for limitation, perfume oils may comprise bergamot, jasmine, musk, vanilla and perfume oil blends. For example only and not for limitation, CBD oils may comprise hemp seed oil, isolate, full-spectrum, broad-spectrum and nano CBD. For example only and not for limitation, hair products may comprise spray hair gel or spray hair conditioner.

Within the dilute reservoir, various dilute fluids may be held. For example only and not for limitation, dilutes may include water, isopropyl myristate, jojoba oil, fractionated coconut oil, propylene glycol, hair products, liquid cosmetics or pre-mixed blends of perfumes/colognes.

The Bottom Section

In some embodiments, the spray device further comprises a bottom section. The bottom section generally provides a base for the spray device. In an example embodiment, the bottom section comprises a removable bottom section having a bottom and a bottom coupler. In some embodiments, the bottom section further comprises a bottom band, a retainer ring and a label.

Figure 14B:
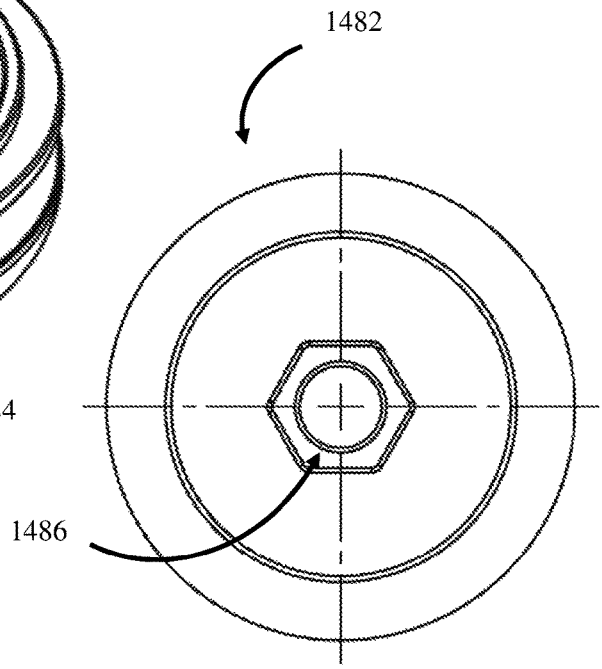
Figure 14C:
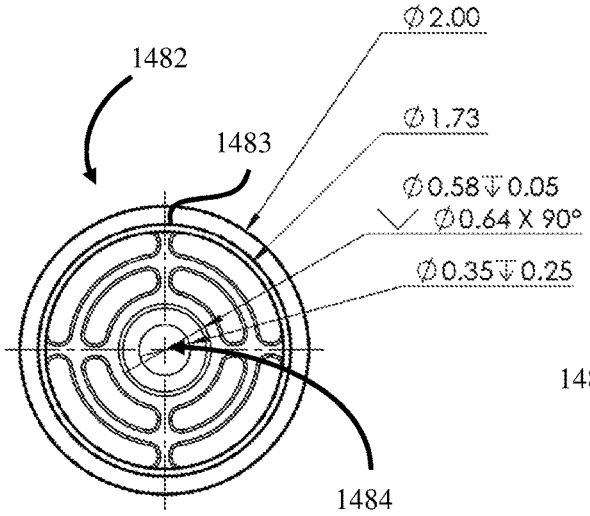
Figure 14D:
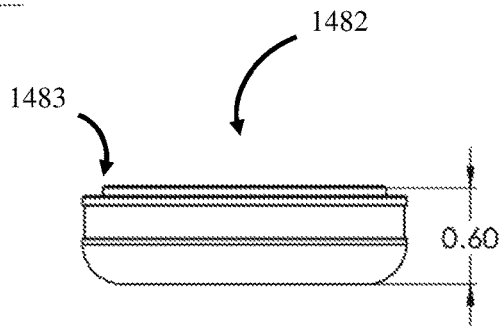

In one example embodiment, referring to FIGS. 14A-14D, the bottom section comprises a bottom 1482. The bottom 1482 is coupled to other elements of the spray device, such as the middle support, by a bottom coupler and locking ring (see FIG. 1B) fitted through opening 1484. FIG. 14B shows a bottom view of the bottom 1482 illustrating a hex shaped recess 1486 to fit a hex head screw as the bottom coupler.

The bottom 1482 may also have a raised mating ring 1483 to mate with other device elements such as the bottom channels of the middle section and the cartridge section.

The bottom may be made any size suitable for use with the other spray device sections. In one embodiment, the bottom has a diameter of about 2.00 inches, and a thickness of about 0.60 inches.

The bottom may be made from any suitable material. In one example embodiment, the bottom 1482 is made from ABS.

Figure 15A:
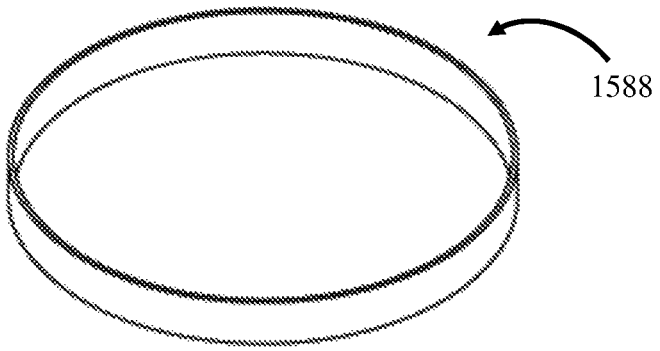
FIGS. 15A-15C show a perspective, top and side view of the bottom band of the spray device.
Figure 15B:
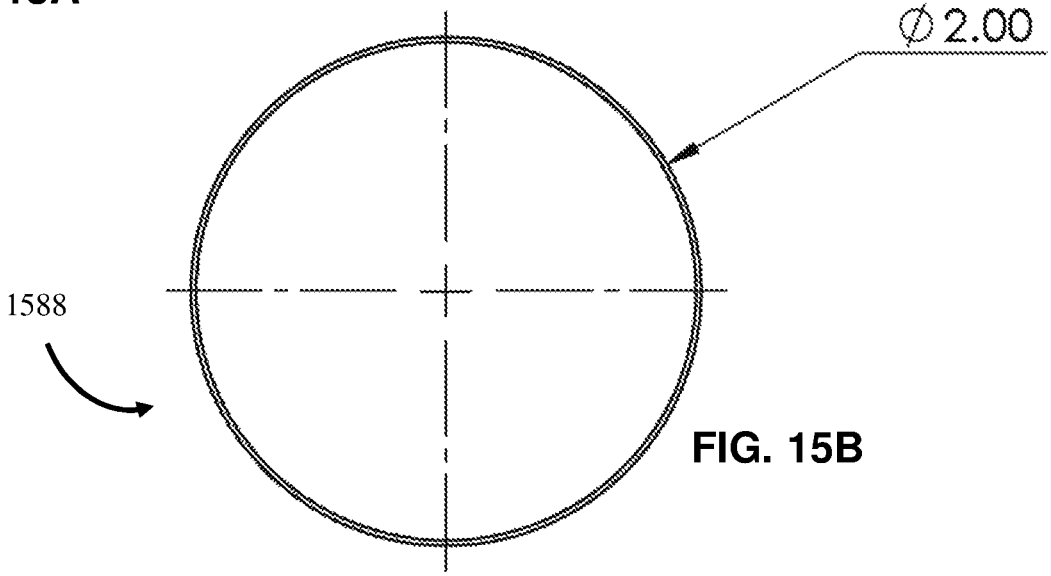
Figure 15C:
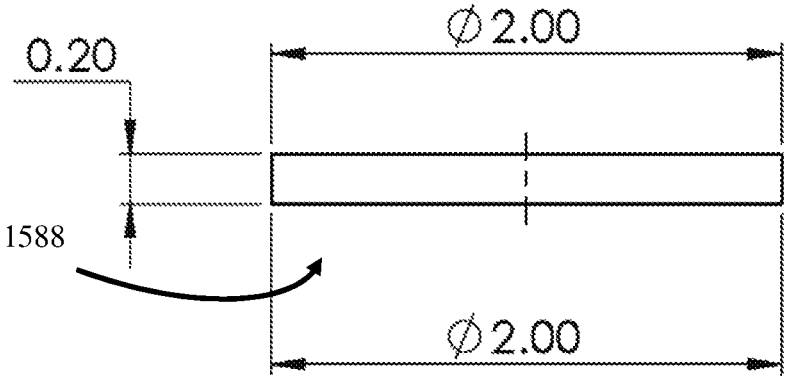

Some embodiments of the bottom section further comprise a bottom band. In the example embodiment of FIGS. 15A-15C, a bottom band 1588 is shown which generally fits around the bottom section.

The bottom band 1588 may be made any size suitable for use with the other spray device sections. In one embodiment, the bottom band 1588 has a diameter of about 2.00 inches, a thickness of about 0.018 inches, and a height of about 0.2 inches.

The bottom band 1588 may be made from any suitable material. In one example embodiment, the bottom band 1588 is an adhesive gold foil band which wraps around the exterior bottom section of the device.

Referring to FIG. 1B, the use of the bottom section 180 to further secure the cartridge section 160 to the middle section 150 also allows the cartridge to be inserted securely into the manifold to minimize the risk of loss of fluid from the reservoir. A tight fit of the bottom section 180 to the cartridge section 160 also minimizes the movement of the cartridge when it is coupled to the manifold and helps ensure that the seal formed with the sealing ring is not compromised.

The Piston Section

In some embodiments, the spray device further comprises a piston section. The piston section generally provides the pumping mechanism and coupling elements to deliver fluids from the middle section to the outside of the spray device.

Figure 16A:
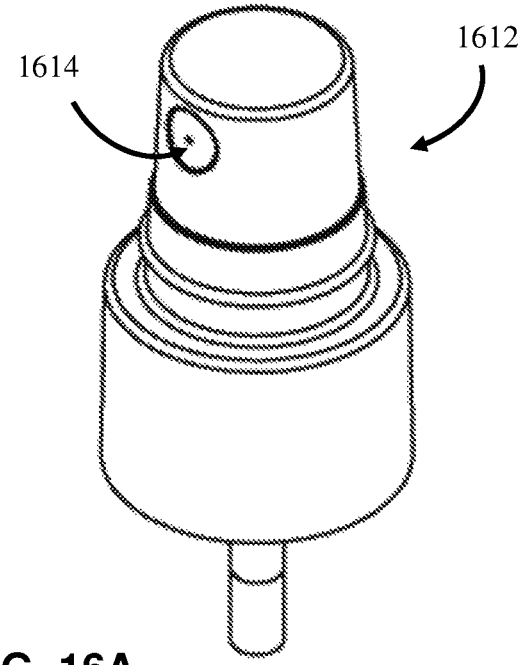
FIGS. 16A-16C show a perspective, top and side view of a pump and nozzle of the spray device.
Figure 16B:
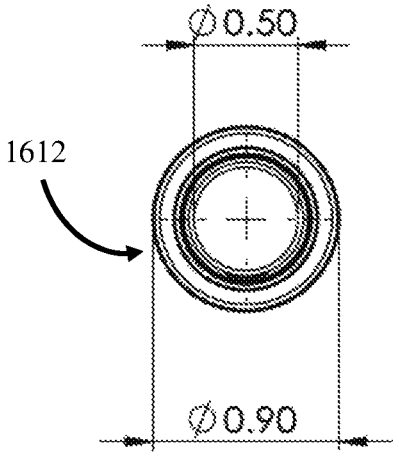
Figure 16C:
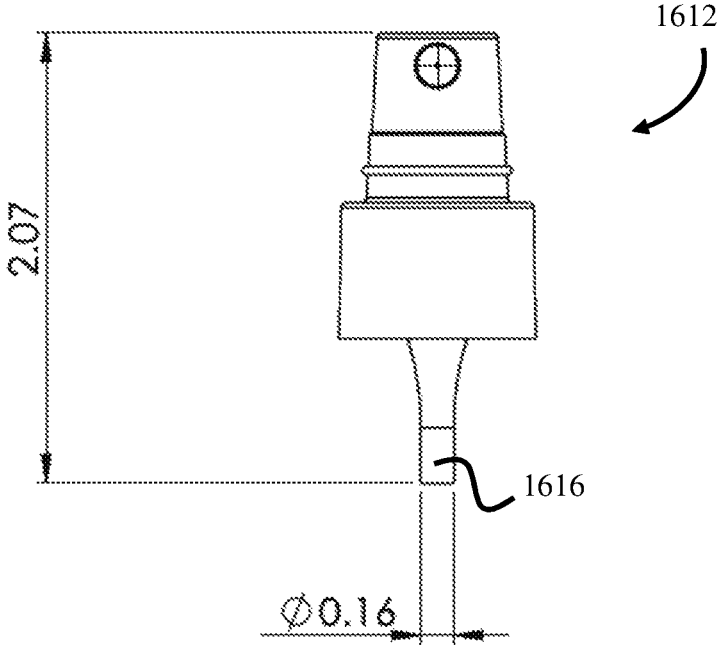

In one example embodiment, referring to FIGS. 16A-16C, the piston section 1610 comprises a pump (internal, not shown) with a nozzle 1614 and a tube 1616. The pump 1612 may be any type of pump that is able to draw and dispense fluid from a reservoir.

In one example embodiment, the pump 1612 is configured to move in one direction for discharging fluid out a pump chamber to the nozzle and move in a second direction for drawing fluid into the pump chamber. For example, the pump 1612 may be a one-way valve pump configured to pull fluid from the manifold using a one-way valve. The one-way valve pump may be any type such as the type used with common window cleaning spray bottles and cologne bottles. In this embodiment, the pump 1612, powered by a trigger mechanism, forces the fluid through the nozzle 1614 that breaks up the flow of the fluid, turning it into a fine mist or stream. The pump 1612 comprising the trigger mechanism, a piston, a cylinder and a one-way valve. When the user presses the trigger mechanism, it forces the piston into the cylinder (acting as a pump chamber) and by reducing the volume of the pump chamber, the piston forces the fluid through the nozzle 1614 as a concentrated stream of fluid. When the trigger mechanism is released, the piston moves back increasing the cylinder volume, pulling fluid back into the cylinder and the pump chamber. This fluid is forced out of the nozzle 1614 the next time the trigger is pressed. The one-way valve at the bottom of the pump 1612 only allows fluid to flow up the tube into the pump 1612, not back into the fluid reservoirs.

The nozzle 1614 is the end of the internal fluid delivery chamber of the piston section and may be made from any suitable material. In some embodiments, it is made of a metal or a plastic. When the air and mixed fluids pass through the nozzle 1614, it causes the fluid to break up into small drops and mixes it with the air. The restriction at the end of the nozzle 1614, called a "venturi," speeds up the air and fluid mixture causing the fluid to break up and the air to disperse it widely.

In one example embodiment, the pump 1612 is a common aspirating pump configured to pull fluid from the manifold using a squeeze bulb, nozzle, a feeder tube, a top tube and Bernoulli's principle. The fluid is stored in the cartridge reservoir. The feeder tube is fluidly connected to the interior conduit of the manifold and the pump 1612 and the cartridge tube. The pump 1612 also houses a top tube that connects a squeeze bulb and the nozzle. When the squeeze bulb is squeezed, air is forced out of the bulb through the top tube, over the feeder tube and out through the nozzle 1614. This passage of air across the feeder tube creates a vacuum that pulls the fluid up into the feeder tube, into the top tube and pushes it out through the nozzle 1614. When the airflow stops, a small amount of fluid remains in the tube and, because of the cohesion properties of fluids, can act as another mechanism to pull fluid up the tube once the bulb is squeezed again.

Figure 17A:
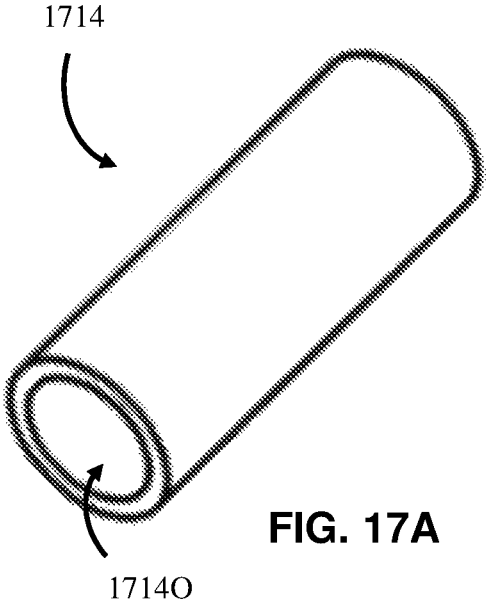
FIGS. 17A-17C show a perspective, side and top view of an example embodiment of a coupling tube used within the spray device.
Figure 17B:
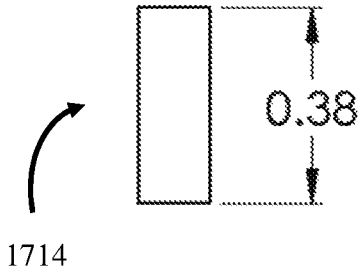
Figure 17C:
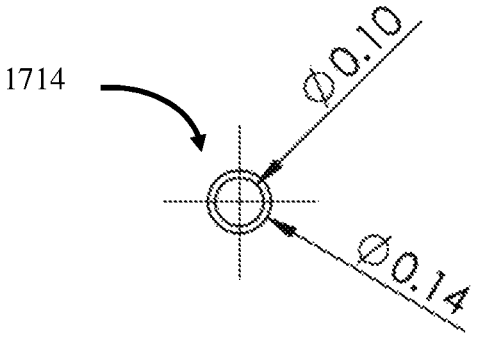
Figure 18A:
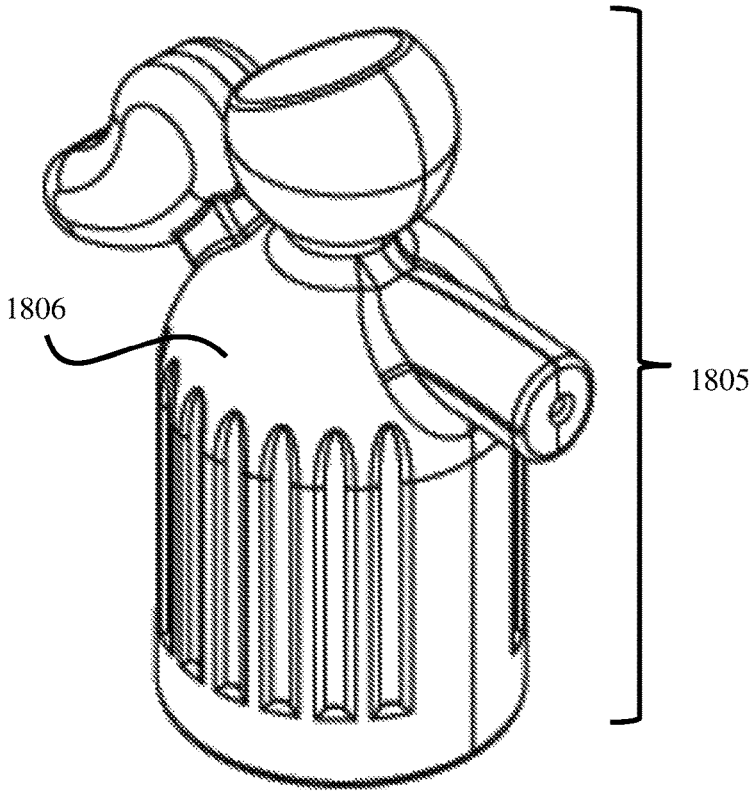
FIG. 18A-18D show a perspective, front, top and side view of the cap of the spray device.
Figure 18B:
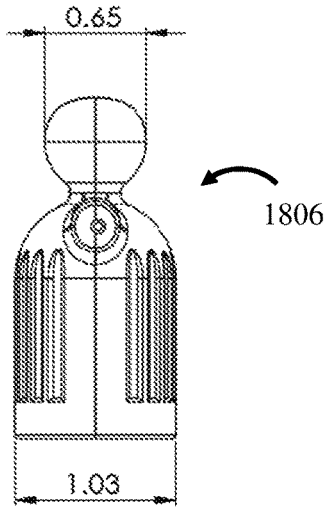
Figure 18C:
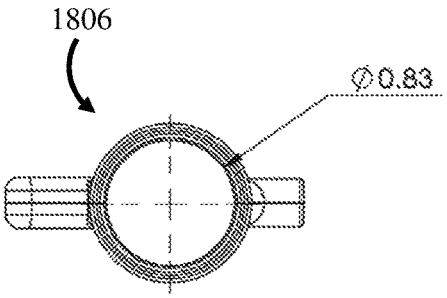
Figure 18D:
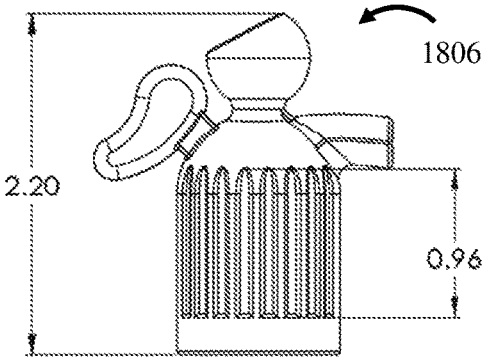

In some embodiments, the piston section further comprises a coupling tube. Referring to FIGS. 17A-17C, the coupling tube 1714 generally couples the pump to the tube fitting of the middle section with a through opening 17140. The coupling tube 1714 may be any size suitable to couple the pump to the tube fitting. In one example embodiment, the coupling tube 1714 has an outside diameter of about 0.14 inches, an inside diameter of about 0.10 inches and the tube itself is about 0.38 inches in length.

The Cap Section

In some embodiments, the spray device further comprises a cap section. The cap section generally covers the pumping trigger of the pumping mechanism.

In one example embodiment, referring to FIGS. 18A-18D, the cap section 1805 comprises a cap 1806 configured to fit over the trigger of the pumping mechanism so that the pump trigger can be exposed when the cap 1806 is removed. The dimensions of the cap 1806 may be made any size to cooperate with other sections of the spray device. In one example embodiment, from the top of the cap 1806 to its base is a distance of about 1.797 inches. The cap 1806 may be made from any suitable material. In one embodiment, plated ABS is used for the cap's composition. Operationally, the cap, like a common cologne bottle, is removed to expose the pump trigger to let the user actuate the pump and draw the fluid from the two cartridges through the manifold and the piston section to exit from the spray nozzle.

The Label

Figure 19:
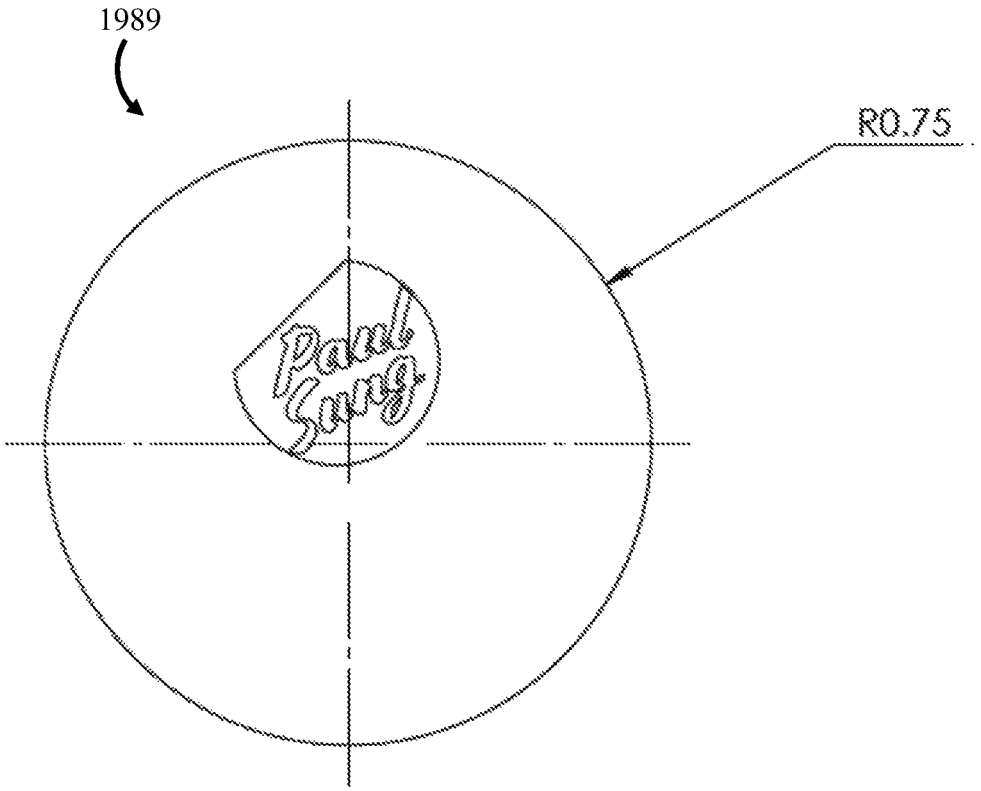
FIG. 19 shows a bottom view of the bottom section of the spray device.
Figure 20:
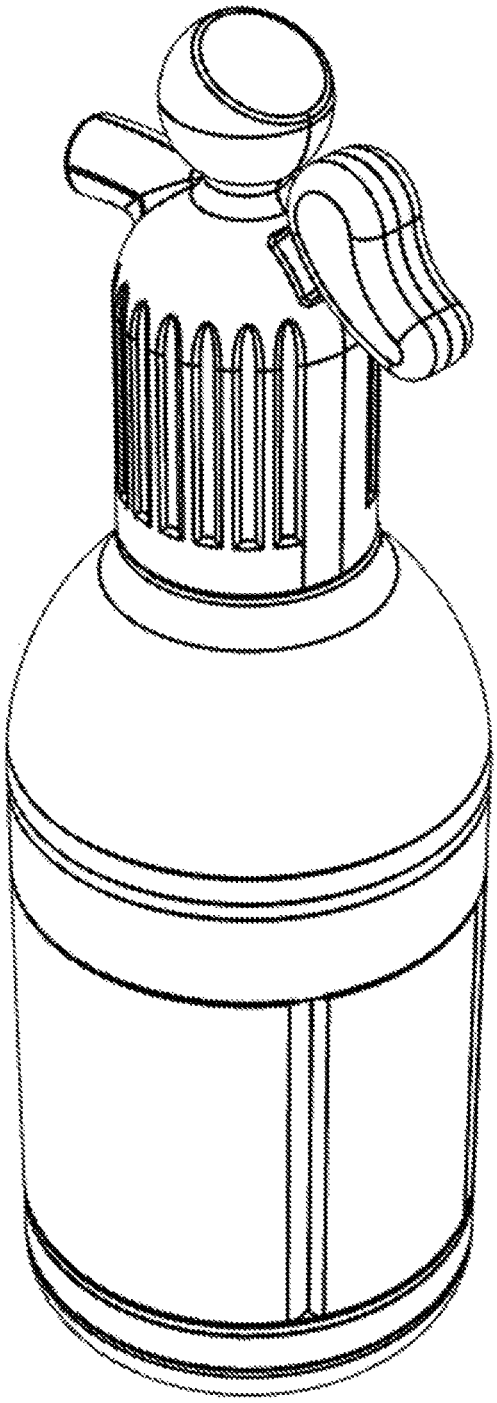
FIG. 20 shows a top-side-rear perspective view illustrating an ornamental design for a spray device with interchangeable cartridges.
Figure 21A:
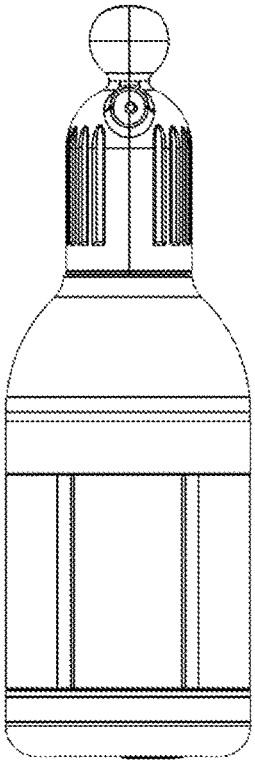
FIGS. 21A-21F respectively show front, rear, right side, left side, top and bottom views illustrating the ornamental design for a spray device with interchangeable cartridges.
Figure 21B:
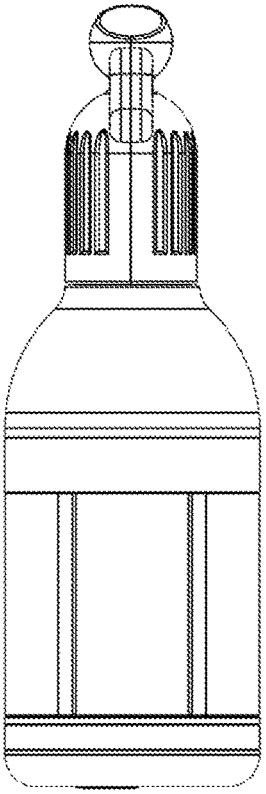
Figure 21E:
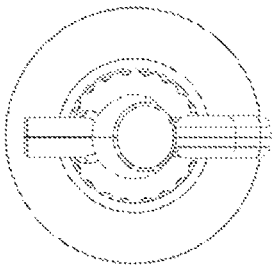
Figure 21C:
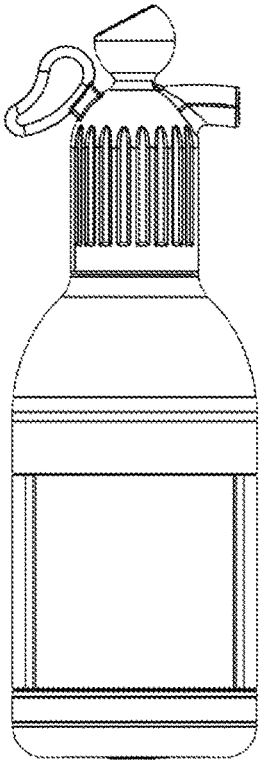
Figure 21D:
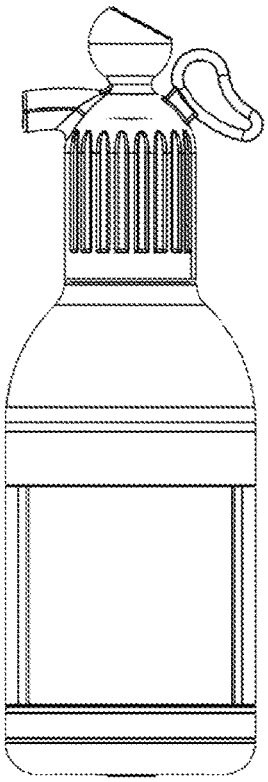
Figure 21F:
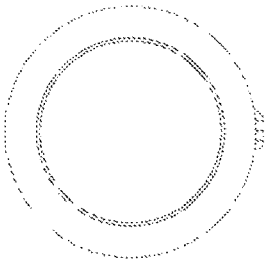
Figure 22A:
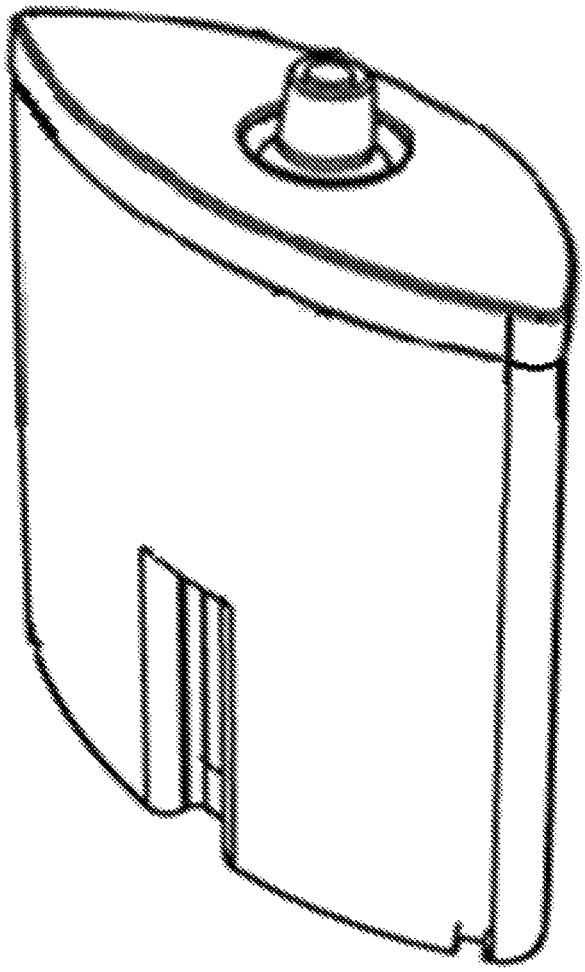
Figure 22B:
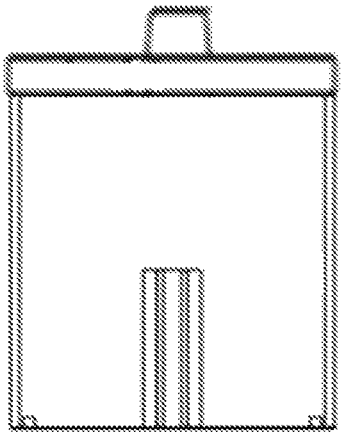
Figure 22C:
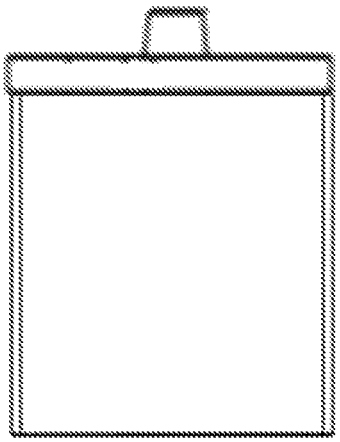
Figure 22F:
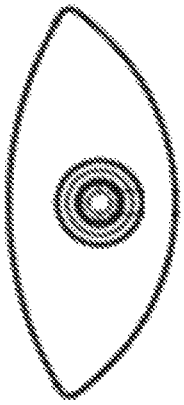
Figure 22D:
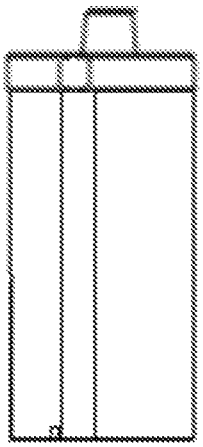
Figure 21E:
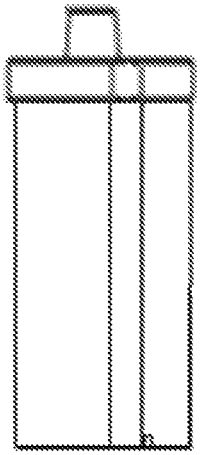
Figure 22G:
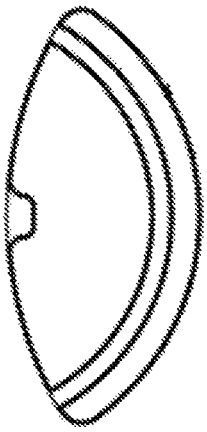

In some embodiments, the spray device further comprises a label. One example embodiment of a bottom label 1989 is shown in FIG. 19 which fits on and adheres to the bottom of the spray device. When placed over the bottom coupler, the bottom label 1989 also helps to hold the coupler in the recess of the bottom section.

Ornamental Designs

The ornamental design for one embodiment of a spray device with interchangeable cartridges is shown in FIGS. 20 and 21A-21F.

The ornamental design for one embodiment of a removable cartridge for a spray device with interchangeable cartridges is shown in FIGS. 22A-22G.

One Embodiment of the Spray Device in Operation:

Methods of use will be described through the operation of an example embodiment of the spray device.

Operation of the spray device generally comprises the steps of selecting the fluid concentrate and fluid dilute, ensuing the cartridge contain the fluids, placing the cartridges in the spray device, activating the trigger mechanism of the piston section so that fluid is pulled from the cartridges, mixing the fluids in the manifold and dispensing them through the nozzle.

For purposes of illustrating the operation of one embodiment of a spray device, and not for limitation, the operation of a spray device consistent with the embodiment shown in FIGS. 1A-1B is described.

The first step comprises selecting the fluid concentrate and the fluid dilute and ensuring they are in the cartridges. The fluids may be prefilled in sealed cartridges or the cartridges may allow the user to add the fluids. In one example embodiment, the cartridges are pre-filled, the dilute may comprise an alcohol or a carrier oil such as jojoba or coconut oil and the fluid concentrate may comprise an essential oil, a cannabidiol (CBD) oil or a fragrance oil.

The cartridges are then inserted into the spray device. In this embodiment, the bottom of the stray device is removed to allow the top of the cartridge lid to be inserted into the cartridge lid engagement area and the shoulder recess to engage the middle shoulder. With both the fluid dilute cartridge and the fluid concentrate cartridge inserted and secured, the bottom is secured by screwing it in the with the bottom coupler. The hex recess in the bottom helps secure the bottom coupler/screw, while the label over the coupler keeps the coupler head seated in the recess.

With both cartridges inserted, the spray device is ready to dispense the mixture of fluids. The fluids are dispensed by the pressure differential create by activating the pump of the piston section. Until it is primed, when the pump is triggered, air is drawn into the pump which creates a vacuum to be replaced by the fluids in each of the containers. When sufficient activation has been performed, the pump draws fluids from the cartridge reservoirs through the cartridge conduit through the lid and into the manifold. The fluids are mixed in the internal conduit of the manifold and the pump draws the mixed fluid into a pump chamber that disperses the fluid through the nozzle.

After the pump dispenses the fluid, a small amount of mixed fluid may remain within the internal conduit of the manifold. The mixing pool within the internal conduit, (beneath the tube fitting) captures a portion of this remaining fluid (mixed at the predetermined ratio) until the pump is activated again. The internal conduit of the manifold operates as partially full of fluid during operation and also when not in use. Back flow of mixed fluids into the fluid cartridges is minimized by the design of the internal conduit.

As the fluid is used, the cartridges may be replaced by removing the bottom, pulling out the existing cartridge and replacing it with a new cartridge. The cartridges may be made from a clear material so that the user can visually tell the amount of fluid in the reservoir.

Although this invention has been described in the above forms with a certain degree of particularity, it is understood that the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention which is defined in the claims and their equivalents.

I claim:

1. A spray device for delivering a mixture of a fluid concentrate and a fluid dilute, the spray device comprising:

a removable fluid concentrate reservoir configured to hold a fluid concentrate;

the removable fluid concentrate reservoir is defined by a removable fluid concentrate cartridge;

a fluid dilute reservoir configured to hold a fluid dilute;

the fluid dilute reservoir is defined by a removable fluid dilute cartridge;

a pump in fluid communication with the removable fluid concentrate reservoir and the fluid dilute reservoir;

a top section comprising a manifold and the pump;

a middle section coupled to the top section and configured to retain the manifold in the top section;

the removable fluid concentrate cartridge and the removable fluid dilute cartridge each having a shoulder recess configured to mate with a middle shoulder of the middle section;

the manifold configured to mix a portion of a fluid concentrate from the removable fluid concentrate reservoir with a portion of the fluid dilute from the fluid dilute reservoir; and the pump in fluid communication with the manifold whereby the pump can receive the fluid concentrate and the fluid dilute from the manifold and deliver a mixture of the fluid concentrate and the fluid dilute.

2. The spray device of claim 1 wherein the fluid concentrate comprises a perfume.

3. The spray device of claim 1 wherein the fluid concentrate comprises an essential oil.

4. The spray device of claim 1 further comprising:

the pump in fluid communication with an internal conduit of the manifold whereby the pump can receive the fluid concentrate and the fluid dilute from the internal conduit;

the removable fluid concentrate cartridge and the removable fluid dilute cartridge each having a lid with a manifold coupler configured to couple with a cartridge lid engagement area in the manifold;

a sealing ring configured to couple and fluidly seal the manifold coupler with the cartridge lid engagement area;

and the removable fluid concentrate cartridge and the removable fluid dilute cartridge each having a tube configured to mate with a tube coupler and the manifold whereby the internal conduit of the manifold is in fluid communication with the removable fluid concentrate reservoir and the fluid dilute reservoir.

5. The spray device of claim 4 wherein:

the coupling of the manifold coupler with the cartridge lid engagement area limits movement of the removable fluid concentrate cartridge in a direction parallel to a longitudinal axis of the spray device; and the mating of the shoulder recess and the middle shoulder limits a movement of the removable fluid concentrate cartridge in a direction perpendicular to the longitudinal axis of the spray device.

6. The spray device of claim 5 further comprising a removable bottom section configured to retain the removable fluid concentrate cartridge and the removable fluid dilute cartridge.

7. The spray device of claim 1 further comprising:

the pump in fluid communication with an internal conduit of the manifold whereby the pump can receive the fluid concentrate and the fluid dilute from the internal conduit;

the internal conduit comprising a concentrate conduit and a dilute conduit;

the concentrate conduit having a constricted concentrate conduit area;

the dilute conduit having a constricted dilute conduit area; and a ratio of the constricted concentrate conduit area to the constricted dilute conduit area defining a mixing ratio of the fluid concentrate and the fluid dilute.

8. The spray device of claim 7 wherein the constricted concentrate conduit area is defined by a fluid concentrate tube in the removable fluid concentrate cartridge.

9. The spray device of claim 7 wherein the constricted concentrate conduit area is defined by a fluid concentrate conduit of the internal conduit of the manifold.

10. The spray device of claim 7 wherein the ratio comprises a range of about 5:1 to 10:1.

11. A spray device for delivering a mixture of a fluid concentrate and a fluid dilute, the spray device comprising:

a removable fluid concentrate cartridge configured to hold a fluid concentrate;

a removable fluid dilute cartridge configured to hold a fluid dilute;

a pump in fluid communication with the removable fluid concentrate cartridge and the removable fluid dilute cartridge;

a top section comprising a manifold and the pump;

the manifold configured to mix a portion of a fluid concentrate from the removable fluid concentrate cartridge with a portion of the fluid dilute from the removable fluid dilute cartridge;

the pump in fluid communication with the manifold whereby the pump can receive the fluid concentrate and the fluid dilute from the manifold and deliver a mixture of the fluid concentrate and the fluid dilute;

the pump in fluid communication with an internal conduit of the manifold whereby the pump can receive the fluid concentrate and the fluid dilute from the internal conduit;

a middle section coupled to the top section and configured to retain the manifold in the top section;

the removable fluid concentrate cartridge and the removable fluid dilute cartridge each having a lid with a manifold coupler configured to couple with a cartridge lid engagement area in the manifold;

a sealing ring configured to couple and fluidly seal the manifold coupler with the cartridge lid engagement area whereby the coupling of the manifold coupler with the cartridge lid engagement area limits movement of the removable fluid concentrate cartridge in a direction parallel to a longitudinal axis of the spray device;

the removable fluid concentrate cartridge and the removable fluid dilute cartridge each having a shoulder recess configured to mate with a middle shoulder of the middle section whereby the mating of the shoulder recess and the middle shoulder limits a movement of the removable fluid concentrate cartridge in a direction perpendicular to the longitudinal axis of the spray device;

a removable bottom section configured to retain the removable fluid concentrate cartridge and the removable fluid dilute cartridge;

the removable fluid concentrate cartridge and the removable fluid dilute cartridge each having a tube configured to mate with a tube coupler and the manifold whereby the internal conduit of the manifold is in fluid communication with the removable fluid concentrate cartridge and the removable fluid dilute cartridge;

the internal conduit comprising a concentrate conduit and a dilute conduit;

the concentrate conduit having a constricted concentrate conduit area;

the dilute conduit having a constricted dilute conduit area; and a ratio of the constricted concentrate conduit area to the constricted dilute conduit area defining a mixing ratio of the fluid concentrate and the fluid dilute.

12. The spray device of claim 11 wherein the constricted concentrate conduit area is defined by a fluid concentrate tube in the removable fluid concentrate cartridge.

13. The spray device of claim 11 wherein the constricted concentrate conduit area is defined by a fluid concentrate conduit of the internal conduit of the manifold.

14. The spray device of claim 11 wherein the ratio comprises a range of about 5:1 to 10:1.

15. The spray device of claim 11 wherein the fluid concentrate comprises a perfume.

16. The spray device of claim 11 wherein the fluid concentrate comprises an essential oil.

17. A removable fluid cartridge to hold a fluid for use with a spray device, the removable fluid cartridge comprising:

a cartridge body defining a side and a bottom of a cartridge reservoir configured to retain a fluid;

the cartridge body comprising a top and a bottom;

a cartridge lid proximal to the top of the cartridge body and configured to define a top of the cartridge reservoir;

a tube coupled to the cartridge lid;

the tube configured to fluidly connect the cartridge reservoir to the cartridge lid;

the cartridge lid further comprising a lid coupler configured to fluidly connect the tube with the spray device whereby the fluid retained in the cartridge reservoir may be dispense by a pumping mechanism;

the cartridge body further comprising a shoulder recess proximal to the bottom of the cartridge body configured to mate with a middle shoulder of the spray device; and the shoulder recess and the lid coupler configured to couple the cartridge body with the spray device.

18. The removable fluid cartridge of claim 17 wherein:

the tube having an internal diameter predefining a flow of the fluid from the cartridge body; and the removable fluid cartridge further comprises a second removable fluid cartridge, the second removable fluid cartridge comprising;

a second cartridge body defining a second cartridge reservoir configured to retain a second fluid;

a second tube having a second internal diameter predefining a second flow of the second fluid from the second cartridge body;

the second tube configured to fluidly connect the second cartridge reservoir to the cartridge lid;

the lid coupler configured to fluidly connect the second tube with the spray device whereby the second fluid retained in the second cartridge reservoir may be dispense by a pumping mechanism;

the second cartridge body further comprising a second recess configured to mate with the spray device; and the second recess and the lid coupler configured to couple the second cartridge body with the spray device.

19. The removable fluid cartridge of claim 18 wherein the flow of the fluid from the cartridge body and the second flow of the second fluid from the second cartridge body defines a predefined mixing ratio of the fluid with the second fluid from the spray device.

20. The removable fluid cartridge of claim 18 further comprising:

a spray device comprising a top section and a middle section:

the top section comprising a manifold and a pump;

the middle section coupled to the top section and configured to retain the manifold in the top section;

the removable fluid cartridge and the second removable fluid cartridge configured to be retained in the spray device;

the manifold in fluid communication with the fluid cartridge and the second fluid whereby the manifold is configured to mix a portion of a fluid from the fluid cartridge and a second fluid from the second fluid cartridge; and the pump in fluid communication with the manifold whereby the pump can receive the fluid and the second fluid from the manifold and deliver a mixture of the fluid and the second fluid.

* * * * *